US007883164B2

(12) United States Patent
Noro et al.

(10) Patent No.: US 7,883,164 B2
(45) Date of Patent: Feb. 8, 2011

(54) LIQUID STORING DEVICE AND LIQUID STORING CARTRIDGE HAVING A SIMPLE STRUCTURE FOR INK AGITATION AND INK STATE DETECTION

(75) Inventors: Hideo Noro, Minamiminowa-mura (JP); Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 5 days.

(21) Appl. No.: 12/360,952

(22) Filed: Jan. 28, 2009

(65) Prior Publication Data

US 2009/0189931 A1 Jul. 30, 2009

(30) Foreign Application Priority Data

Jan. 29, 2008 (JP) ..... 2008-018123
Jun. 18, 2008 (JP) ..... 2008-159632

(51) Int. Cl.
*B41J 2/195* (2006.01)
*B01F 7/18* (2006.01)
*B01F 11/00* (2006.01)

(52) U.S. Cl. ..... 347/7; 366/249; 366/255

(58) Field of Classification Search ..... 347/7; 366/249, 255, 332

See application file for complete search history.

(56) References Cited

U.S. PATENT DOCUMENTS 2,859,019 A * 11/1958 O'Neill, Jr. ..... 366/280
7,293,849 B2 * 11/2007 Tani et al. ..... 347/6
2001/0017641 A1 * 8/2001 Kobayashi et al. ..... 347/7
2003/0053371 A1 * 3/2003 Schoeb ..... 366/273
2007/0035601 A1 * 2/2007 Jang ..... 347/100
2007/0091716 A1 * 4/2007 Zeikus ..... 366/104

FOREIGN PATENT DOCUMENTS

JP 2002-248783 9/2002
JP 2006-001171 1/2006
JP 2006-103016 4/2006
JP 2006-326377 12/2006
JP 2007-083548 4/2007

OTHER PUBLICATIONS

Machine produced English translation of the specification of foreign patent document JP 2006-326377 to Oide Kosuke, translation retrieved via http://www.ipdl.inpit.go.jp/homepg_e.ipdl on Jun. 17, 2010.*

* cited by examiner

*Primary Examiner*—Matthew Luu
*Assistant Examiner*—Shelby Fidler
(74) *Attorney, Agent, or Firm*—Workman Nydegger

(57) ABSTRACT

A liquid storing device includes a storage unit that stores a liquid to be consumed and a rotation member inside the storage unit that rotates around a rotation axis. A blade member is installed to the rotation member to be movable in the axis direction of the rotation axis with respect to the rotation member and has a specific gravity smaller than that of the liquid. A detection member detects the blade member when the blade member is located vertically at a detection position. When the rotation member rotates in one direction, the blade member agitates the liquid while moving toward the lower side of a liquid surface of the liquid in the vertical direction along the axis direction in accordance with rotation of the rotation member. When the rotation member stops rotating, the blade member floats toward the liquid surface due to buoyancy of the liquid.

7 Claims, 15 Drawing Sheets

LIQUID STORING DEVICE AND LIQUID STORING CARTRIDGE HAVING A SIMPLE STRUCTURE FOR INK AGITATION AND INK STATE DETECTION

The entire disclosure of Japanese Patent Application No. 2008-018123, filed Jan. 29, 2008 and Japanese Patent Application No. 2008-159632, filed Jun. 18, 2008, are expressly incorporated herein by reference.

BACKGROUND

1. Technical Field

The present invention relates to a liquid storing device and a liquid storing cartridge.

2. Related Art

As one type of liquid storing devices, ink jet printers that perform a printing process for an image by discharging ink (liquid) onto various media such as a paper sheet, a cloth, and a film have been known. This printer includes a discharge unit that discharges ink and a storage unit (for example, an ink cartridge) that stores ink to be supplied to the discharge unit. When the amount of ink inside the discharge unit decreases due to discharge of the ink, ink is supplied from the storage unit to the discharge unit.

Here, when a time elapses in a state in which the ink inside the storage unit is not used, the ink inside the storage unit may sink. When the ink sinks, there is a problem that supply of the ink thereafter may not be performed effectively. Accordingly, in order to suppress sedimentation of the ink inside the storage unit, there are printers including an agitation member that agitates the ink.

Since the ink inside the storage unit is consumed in accordance with supply of the ink to the discharge unit, the remaining amount of the ink inside the storage unit changes. Here, in order to supply the ink to the discharge unit in a stable manner, it is preferable that the state of the ink inside the storage unit including the remaining amount of the ink and the like is acquired. Accordingly, there are printers that include a state detecting member (for example, a sensor and a detection member detected by the sensor) that detects the state of the ink inside the storage unit.

A related art has been disclosed in JP-A-2007-83548.

However, recently, simplification of the structure of the device has been requested. Accordingly, agitation of the ink inside the storage unit and detection of the state of the ink are requested to be implemented under a simple structure.

SUMMARY

An advantage of some aspects of the invention is that it provides a liquid storing device and a liquid storing cartridge capable of appropriately agitating the liquid inside the storage unit and appropriately detecting the state of the liquid inside the storage unit under a simple structure.

According to a major aspect of the invention, there is provided a liquid storing device including: a storage unit that stores a liquid to be consumed; a rotation member that is installed to the inside of the storage unit and is rotated around a rotation axis; a blade member that is installed to the rotation member so as to be movable in the axis direction of the rotation axis with respect to the rotation member and has specific gravity smaller than that of the liquid; and a detection member that detects the blade member in a case where the blade member is located at a detection position in the vertical direction. In a case where the rotation member rotates in one direction, the blade member agitates the liquid while moving toward the lower side of a liquid surface of the liquid in the vertical direction along the axis direction in accordance with rotation of the rotation member. Then, when the rotation of the rotation member in the one direction stops, the blade member floats toward the liquid surface due to buoyancy of the liquid.

The other aspects of the invention will be apparent from descriptions below and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
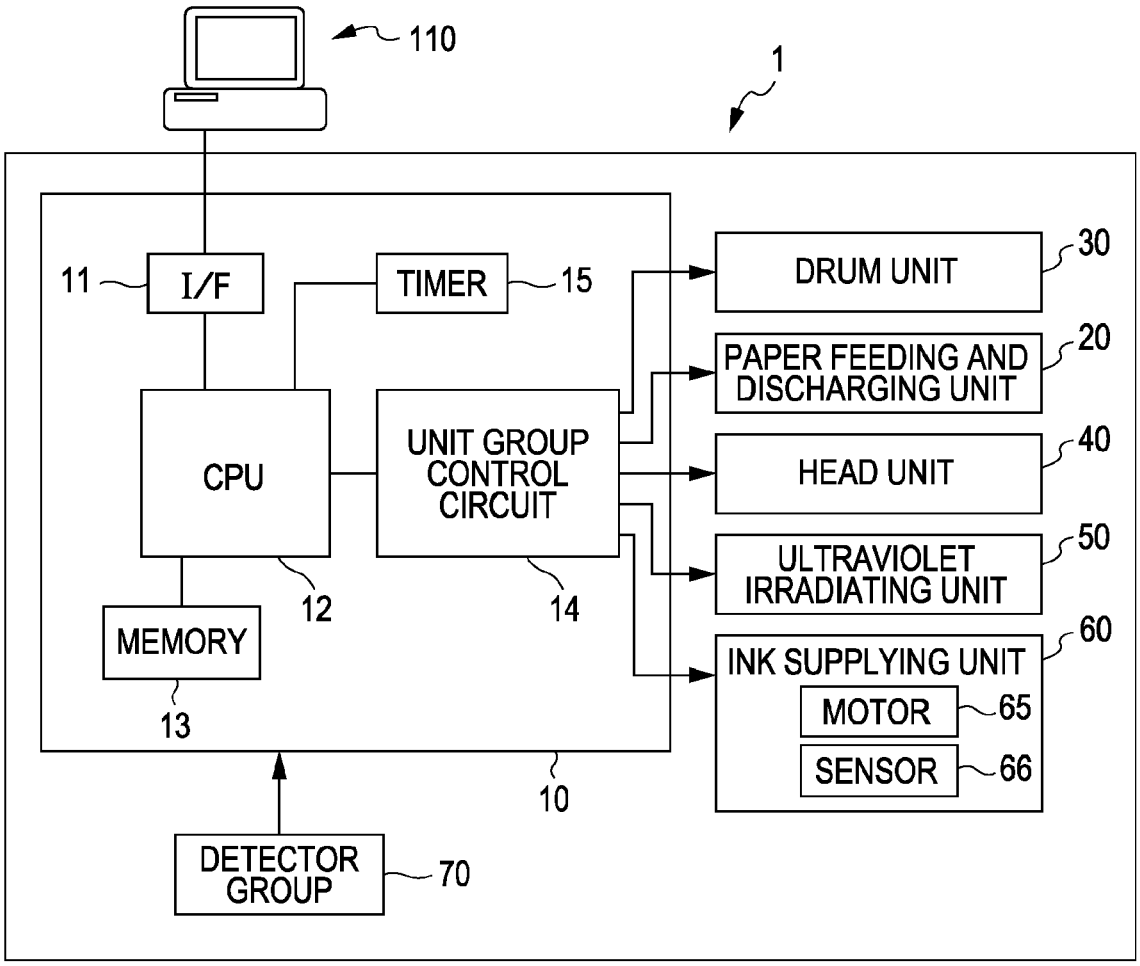
FIG. 1 is a block diagram showing the whole configuration of a printer 1 according to an embodiment of the invention.

At least the followings are disclosed in descriptions below and the accompanying drawings.

According to a first aspect of the invention, there is provided a liquid storing device including: a storage unit that stores a liquid to be consumed; a rotation member that is installed to the inside of the storage unit and is rotated around a rotation axis; a blade member that is installed to the rotation member so as to be movable in the axis direction of the rotation axis with respect to the rotation member and has specific gravity smaller than that of the liquid; and a detection member that detects the blade member in a case where the blade member is located at a detection position in the vertical direction. In a case where the rotation member rotates in one direction, the blade member agitates the liquid while moving toward the lower side of a liquid surface of the liquid in the vertical direction along the axis direction in accordance with rotation of the rotation member. Then, when the rotation of the rotation member in the one direction stops, the blade member floats toward the liquid surface due to buoyancy of the liquid.

According to the above-described liquid storing device, under a simple structure, the liquid inside the storage unit can be agitated appropriately, and the state of the liquid inside the storage unit can be detected appropriately.

Preferably, the above-described liquid storing device further includes a control unit that acquires the amount of the liquid inside the storage unit based on a time from when the rotation of the rotation member in the one direction is started to when the blade member is detected by the detection member.

In such a case, the remaining amount of the liquid inside the storage unit can be detected by using a simple method.

Preferably, the above-described liquid storing device further includes a control unit that determines the amount of the liquid inside the storage unit is equal to or smaller than a predetermined amount at a time when the blade member located at the liquid surface is detected by the detection member in a state in which the blade member is located at the liquid surface in a case where the rotation member is stopped.

In such a case, ink-end (to be described later) can be detected under a simple configuration.

In the above-described liquid storing device, it is preferable that agitation of the liquid is continuously performed by the blade member during the rotation member is rotated in the one direction.

In such a case, sedimentation of the liquid inside the storage unit can be suppressed effectively.

In the above-described liquid storing device, it is preferable that the liquid is ultraviolet curable ink, the blade member has a magnet that generates a magnetic field, the detection member has a hall element that detects the magnetic field generated by the magnet at a time when the magnet approaches the detection member, and it is detected that the blade member is located at the detection position at a time when the hall element detects the magnetic field.

In such a case, even when the liquid is the ultraviolet curable ink, the blade member can be detected by the detection member appropriately.

In the above-described liquid storing device, it is preferable that the rotation member is an angled shaft, the blade member has a hole part having a rectangular shape through which the angled shaft perforates and a blade that is installed to the periphery of the hole part and agitates the liquid, the blade member agitates the liquid while moving toward the lower side of the liquid surface in accordance with rotation of the angled shaft in a state in which the angled shaft is brought into contact with the hole part in a case where the angled shaft is rotated in the one direction, and, the blade member floats toward the liquid surface due to buoyancy in a state in which the angled shaft perforates through the hole part when the rotation of the angled shaft in the one direction is stopped.

In such a case, under a simple structure, the blade member can be moved toward the lower side of the liquid surface during rotation of the rotation member, and the blade member can float toward the liquid surface at a time when the rotation of the rotation member stops.

According to a second aspect of the invention, there is provided a liquid storing cartridge that is detachably attached to a main body of a liquid discharging apparatus. The liquid storing cartridge includes: a storage unit that stores a liquid that is supplied to a discharge unit installed to the main body of the liquid discharging apparatus; a rotation member that is installed to the inside of the storage unit and is rotated around a rotation axis; a blade member that is installed to the rotation member so as to be movable in the axis direction of the rotation axis with respect to the rotation member and has specific gravity smaller than that of the liquid; and a detection member that detects the blade member in a case where the blade member is located at a detection position in the vertical direction. In a case where the rotation member rotates in one direction, the blade member agitates the liquid while moving toward the lower side of a liquid surface of the liquid in the vertical direction along the axis direction in accordance with rotation of the rotation member. Then, when the rotation of the rotation member in the one direction stops, the blade member floats toward the liquid surface due to buoyancy of the liquid.

According to the above-described liquid storing cartridge, under a simple structure, the liquid inside the storage unit can be agitated appropriately, and the state of the liquid inside the storage unit can be detected appropriately.

According to a third aspect of the invention, there is provided a liquid storing device including: a storage unit that stores a liquid to be consumed; a rotation member that is installed to the inside of the storage unit and is rotated around a rotation axis; a blade member that is installed to the rotation member so as to be movable in the axis direction of the rotation axis with respect to the rotation member; and a detection member that detects the blade member in a case where the blade member is located at a detection position in the vertical direction. In a case where the rotation member rotates in one direction, the blade member is rotated to move along the axis direction toward a first side of the vertical direction in accordance with rotation of the rotation member. Then, when the rotation of the rotation member in the one direction stops, the blade member is moved to a second side of the vertical direction that is opposite to the first side.

According to the above-described liquid storing device, under a simple structure, the liquid inside the storage unit can be agitated appropriately, and the state of the liquid inside the storage unit can be detected appropriately.

Preferably, the above-described liquid storing device further includes a control unit that acquires the amount of the liquid inside the storage unit by having the blade member during its movement to the lower side to be detected by the detection member at a time when the blade member is moved to the lower side after being moved to the upper side. In such a case, the specific gravity of the blade member is larger than that of the liquid, and the first side is the upper side of the vertical direction, and the second side is the lower side of the vertical direction.

In the case, even when the specific gravity of the blade member is large, the remaining amount of the liquid inside the storage unit can be detected appropriately by detecting the blade member during its movement to the lower side.

In the above-described liquid storing device, it is preferable that the control unit acquires the amount of the liquid inside the storage unit based on a time from when the blade member moved to the upper side starts to move to the lower side to when the blade member during its movement to the lower side is detected by the detection member.

In such a case, the remaining amount of the liquid inside the storage unit can be detected by using a simple method without disposing a level sensor or the like.

Preferably, the above-described liquid storing device further includes a motor that is used for rotating the blade member. In such a case, the blade member is rotated to move toward the second side in accordance with the rotation of the rotation member in a case where the rotation member is rotated in a different direction that is opposite to the one direction, and the control unit acquires the amount of the liquid inside the storage unit based on the rotation amount of the motor until the blade member in its movement to the lower side is detected by the detection member after the blade member moved to the upper side starts to move toward the lower side.

In such a case, the remaining amount of the liquid inside the storage unit can be detected by using a simple method without disposing a level sensor or the like.

Preferably, the above-described liquid storing device further includes a control unit that determines that the amount of the liquid inside the storage unit is equal to or smaller than a predetermined amount in a case where the detection member continuously detects the blade member during rotation of the rotation member at a time when the rotation member is stopped when a predetermined time elapses after start of the rotation of the rotation member in the one direction.

In such a case, the ink-end (to be described later) can be detected by using a simple configuration without disposing a level sensor or the like.

In the above-described liquid storing device, it is preferable that the blade member has a base part including a hole part through which the rotation member perforates, a plurality of blades that extends from the base part in a radial pattern, a circle-shaped connection part that connects the front end portions of the plurality of blades, and a plurality of detection parts that is installed to the outer circumference of the connection part and is detected by the detection member.

In such a case, the durability of the blade member can be improved by the connection part, and the liquid can be agitated effectively.

According to a fourth aspect of the invention, there is provided a liquid storing cartridge that is detachably attached to a main body of a liquid discharging apparatus. The liquid storing cartridge includes: a storage unit that stores a liquid to be consumed; a rotation member that is installed to the inside of the storage unit and is rotated around a rotation axis; a blade member that is installed to the rotation member so as to be movable in the axis direction of the rotation axis with respect to the rotation member; and a detection member that detects the blade member in a case where the blade member is located at a detection position in the vertical direction. In a case where the rotation member is rotated in one direction, the blade member is rotated to move toward a first side of the vertical direction along the axis direction in accordance with the rotation of the rotation member, and, when the rotation of the rotation member in the one direction stops, the blade member is moved to a second side that is opposite to the first side of the vertical direction.

According to the above-described liquid storing cartridge, under a simple structure, the liquid inside the storage unit can be agitated appropriately, and the state of the liquid inside the storage unit can be detected appropriately.

Overview of Ink Jet Printer

As an example of a liquid storing device, an ink jet printer (hereinafter, referred to as a printer 1) will be exemplified. An example of the configuration of the printer 1 and an example of a printing process of the printer will now be described.

Configuration of Printer 1

Figure 2:
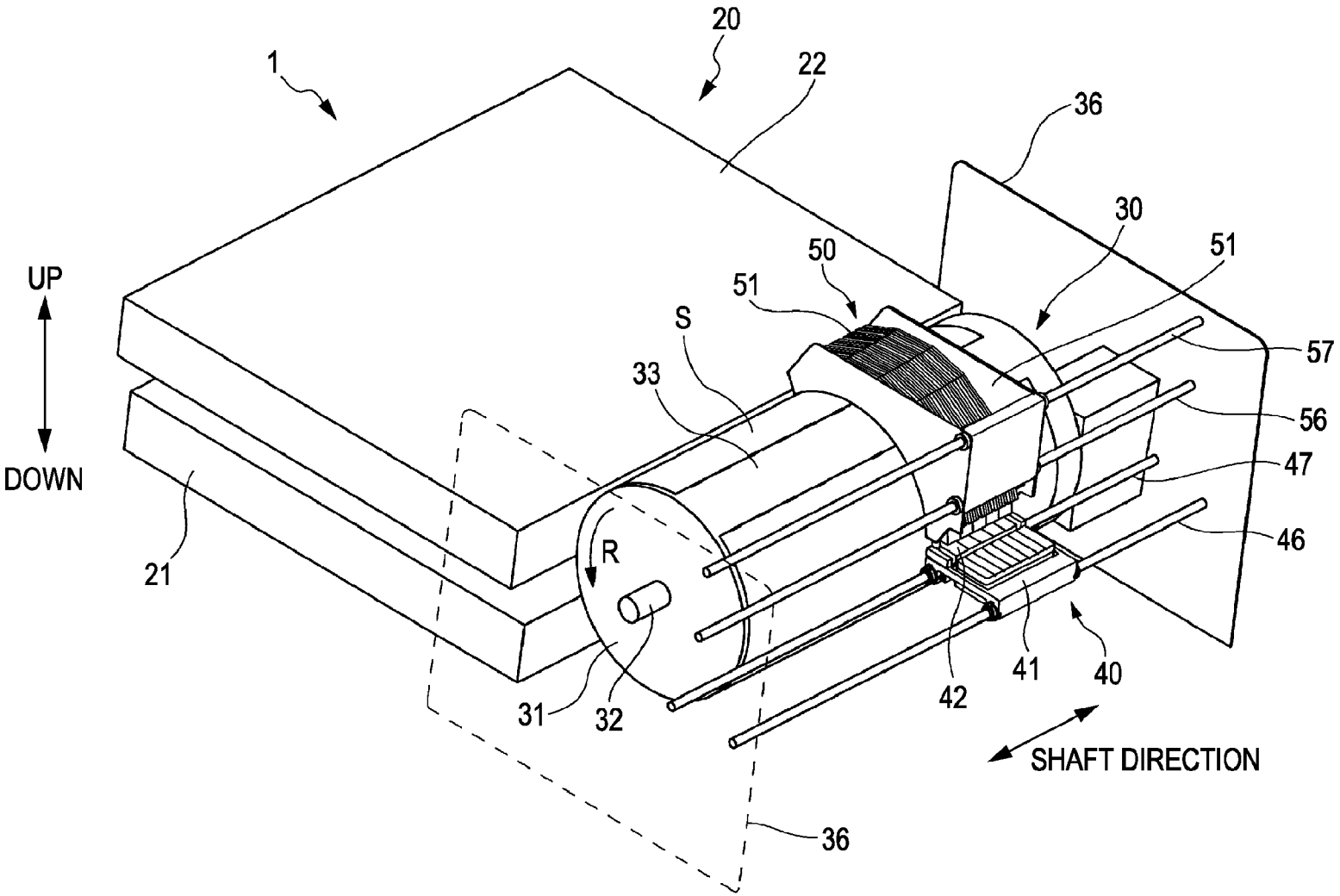
FIG. 2 is a diagram showing the configuration of major parts of the printer 1.
Figure 3:
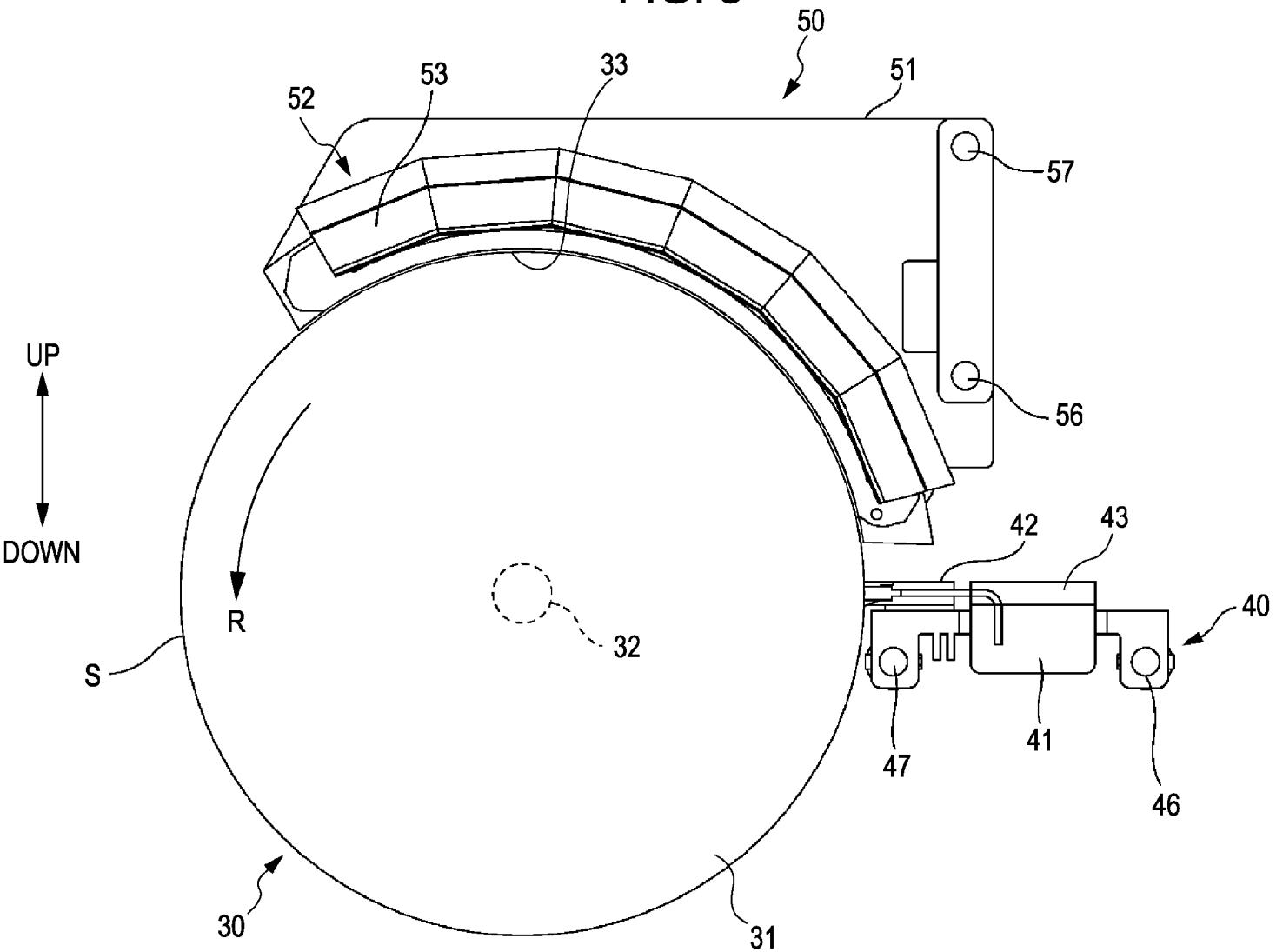
FIG. 3 is a diagram showing the structure of the cross-section of a drum unit 30, a head unit 40, and an ultraviolet irradiation unit 50 according to an embodiment of the invention.
Figure 4A:
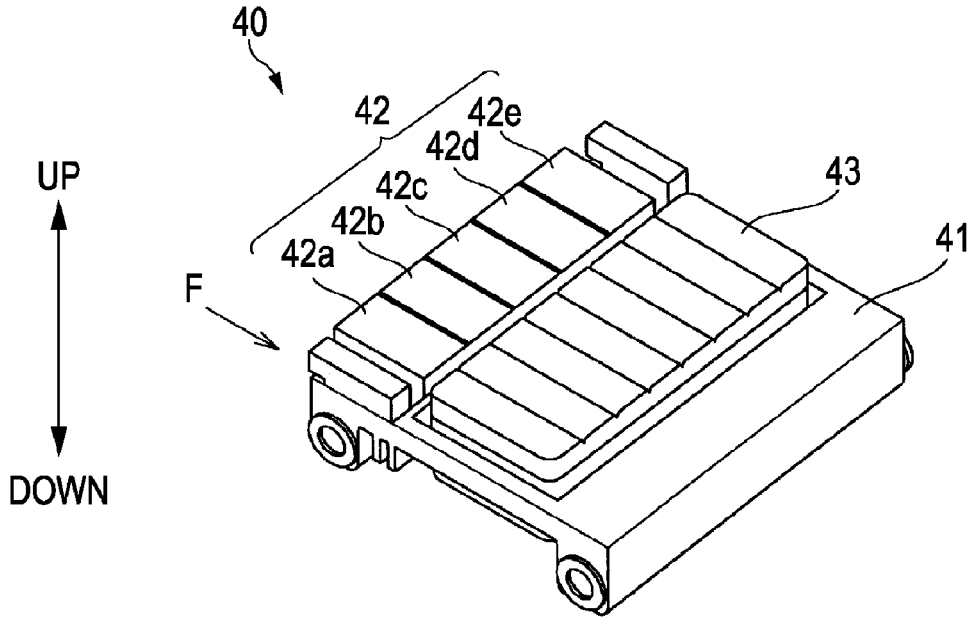
FIG. 4A is a perspective view of the head unit 40.
Figure 4B:
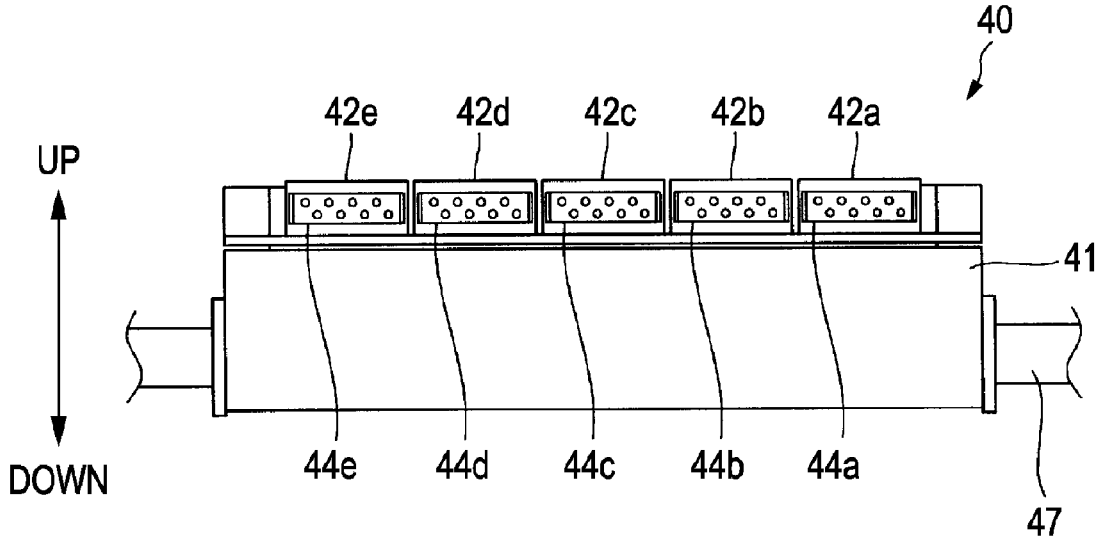
FIG. 4B is a front view of a head 42 in a case where the head 42 is viewed from the direction denoted by an arrow F shown in FIG. 4A.

FIG. 1 is a block diagram showing the whole configuration of the printer 1. FIG. 2 is a diagram showing the configuration of major parts of the printer 1. FIG. 3 is a diagram showing the structure of the cross-section of a drum unit 30, a head unit 40, and an ultraviolet irradiation unit 50. FIG. 4A is a perspective view of the head unit 40. FIG. 4B is a front view of a head 42 in a case where the head 42 is viewed from the direction denoted by an arrow F shown in FIG. 4A.

When receiving print data from a computer 110 as an external apparatus, the printer 1 forms an image on a paper sheet S by controlling each unit (a paper feeding and discharging unit 20, a drum unit 30, a head unit 40 that is an example of a discharge unit, an ultraviolet irradiation unit 50, and an ink supplying unit 60) by using a controller 10 (a printing process). In addition, a detector group 70 monitors the state of the inside of the printer 1, and the controller 10 controls each unit based on the result of detection.

The controller 10 is a control unit that is used for controlling the printer 1. An interface section 11 is used for performing data transmission between the computer 110 as an external apparatus and the printer 1. A CPU 12 is an arithmetic processing device for controlling the entire operation of the printer 1. A memory 13 is used for acquiring an area for storing a program of the CPU 12, a work area, and the like. The CPU 12 controls each unit in accordance with the program stored in the memory 13 by using a unit control circuit 14. A timer 15 is used for measuring a time.

The paper feeding and discharging unit 20, as shown in FIG. 2, is formed of a paper feeding section 21 and a paper discharging section 22. The paper feeding section 21 has a paper feed roller (not shown) that feeds a paper sheet S and feeds paper sheets S that are laminated inside the paper feeding section 21 to a drum unit 30 one after another. The paper discharging section 22 has a paper discharge roller (not shown) that transports a paper sheet S. The paper discharging section 22 transports the paper sheet S, which is supported by the drum unit 30 and for which a printing process is completed, into the paper discharging section 22.

The drum unit 30 includes a holding drum 31 that holds the paper sheet S that is fed from the paper feeding section 21. A rotation shaft 32 of the holding drum 31 is supported by one pair of frames 36 to be rotatable. The holding drum 31 is rotated in the direction of an arrow R shown in FIG. 2 in a state in which the paper sheet S is held on the outer circumferential surface 33.

The head unit 40 includes a head carriage 41 that can reciprocate in the direction of the shaft of the holding drum 31 by being supported by one pair of guide shafts 46 and 47. To the head carriage 41, a head 42 that discharges ink as a liquid onto a paper sheet S is installed. Here, according to this embodiment, five heads 42*a* to 42*e* (FIG. 4B) that discharge ink of different colors as the heads 42 are installed to face the paper sheet S that is held by the holding drum 31. In addition, the heads 42*a* to 42*e* include nozzle plates 44*a* to 44*e* in which a plurality of nozzles is formed, and ink is discharged from the nozzles. In addition, to each nozzle, a driving element (piezo element) that is used for discharging ink by changing a pressure chamber (not shown) in which ink flows in and the volume of the pressure chamber is installed.

In addition, to the head carriage 41, a storage chamber 43 that stores ink is installed. From this storage chamber 43, ink of a predetermined amount is supplied to the head 42. According to this embodiment, ultraviolet curable ink that is cured by irradiation of ultraviolet rays is used as the ink. Here, the ultraviolet curable ink is prepared by adding a supplement such as an antifoam agent or a polymerization inhibitor to a mixture of a vehicle, a photopolymerization initiator, and a pigment. In addition, the vehicle is prepared by adjusting the viscosity of olygomer, monomer, or the like having photopolymerization curability by using reactive diluents.

The ultraviolet irradiation unit 50 includes an irradiation unit carriage 51 that can reciprocate in the direction of the shaft of the holding drum 31 by being supported by one pair of guide shafts 56 and 57. To the irradiation unit carriage 51, an ultraviolet irradiation section 52 that irradiates ultraviolet rays onto ink that is discharged from the head 42 and adhered to the paper sheet S is installed. The ultraviolet irradiation section 52 includes a plurality of lamps 53 that is arranged along the rotation direction of the holding drum 31. As the plurality of lamps 53 irradiates ultraviolet rays onto ink on the paper sheet S, the ink is cured.

The ink supplying unit 60 is used for supplying ink to the storage chamber 43 in a case where the amount of ink inside the head unit 40 (in particular, the storage chamber 43) decreases due to discharge of ink performed by the head 42. A detailed configuration of the ink supplying unit 60 will be described later.

Printing Process

When receiving a print command and print data from the computer 110, the controller 10 analyses the content of various commands included in the print data and performs the following printing process by using each unit.

First, the paper feeding section 21 feeds a paper sheet S toward the holding drum 31. The paper sheet S that is fed to the holding drum 31 is held by being wound around the outer circumferential face 33. Then, the held paper sheet S is rotated together with the holding drum 31. The heads 42 have ink adheres to the rotating paper sheet S by discharging ink. The ink adhered to the paper sheet S is moved in accordance with rotation of the holding drum 31, and an ultraviolet irradiation section 52 irradiates ultraviolet rays thereto. Accordingly, the ink on the paper sheet S is cured so as to form an image on the paper sheet S.

When the image is printed in a partial area of the paper sheet S in the direction of the shaft of the holding drum 31 in a case where the holding drum 31 rotates one revolution, the head carriage 41 is moved along the guide shafts 46 and 47 (the irradiation unit carriage 51 is also moved along the guide shafts 56 and 57 in the same manner). Then, the above-described operations (the ink discharge by the heads 42 and irradiation of ultraviolet rays by the ultraviolet irradiation section 52) are performed for an area that is adjacent to the above-described area in the direction of the shaft.

The paper sheet S on which the whole image is printed in the direction of the shaft of the holding drum 31 in the manner described above, is peeled apart from the holding drum 31 and is transported to the paper discharging section 22. Accordingly, the printing process is completed.

Example of Configuration of Ink Supplying Unit 60

Figure 5:
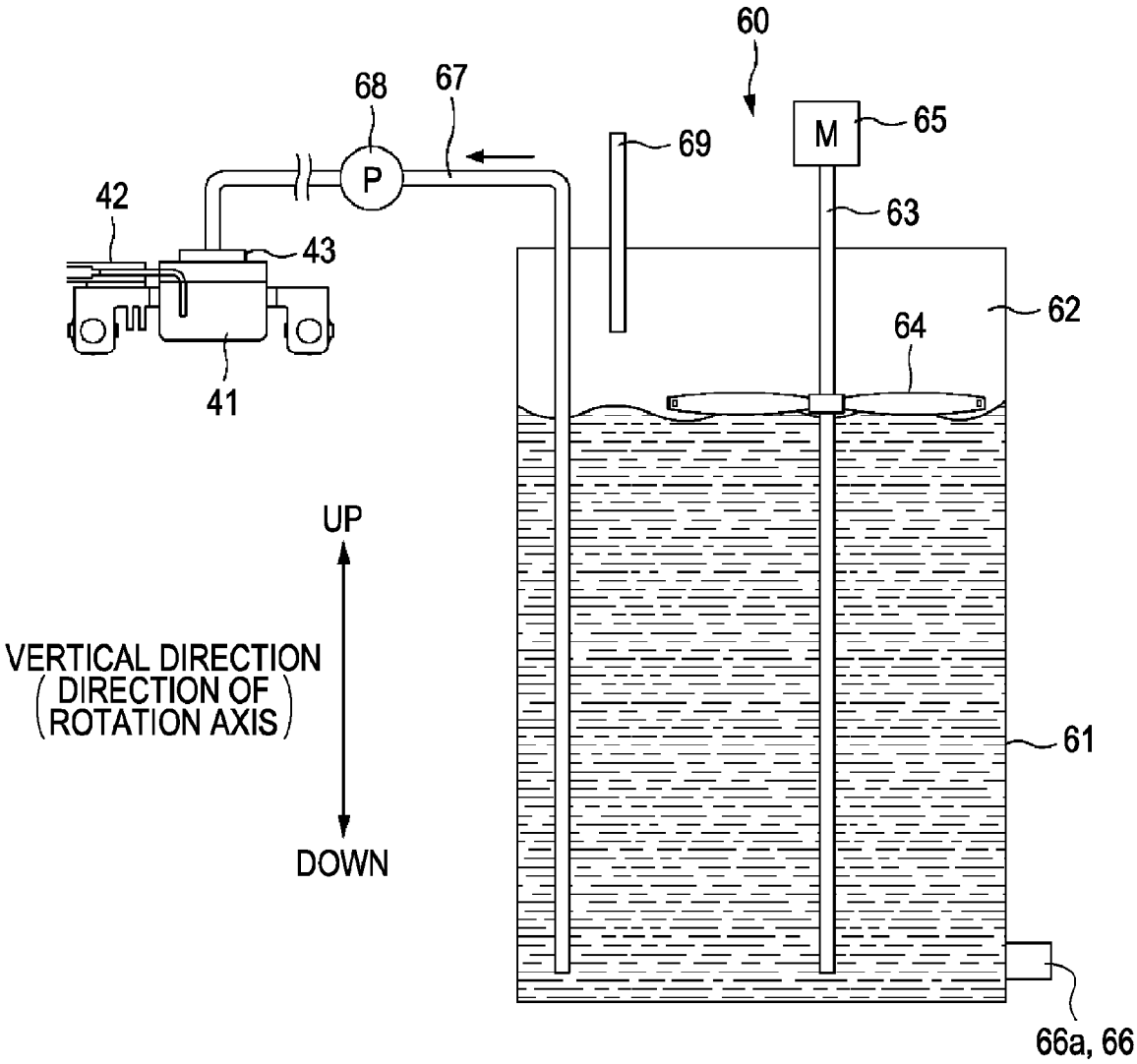
FIG. 5 is a schematic diagram showing the configuration of an ink supplying unit 60 according to an embodiment of the invention.
Figure 6:
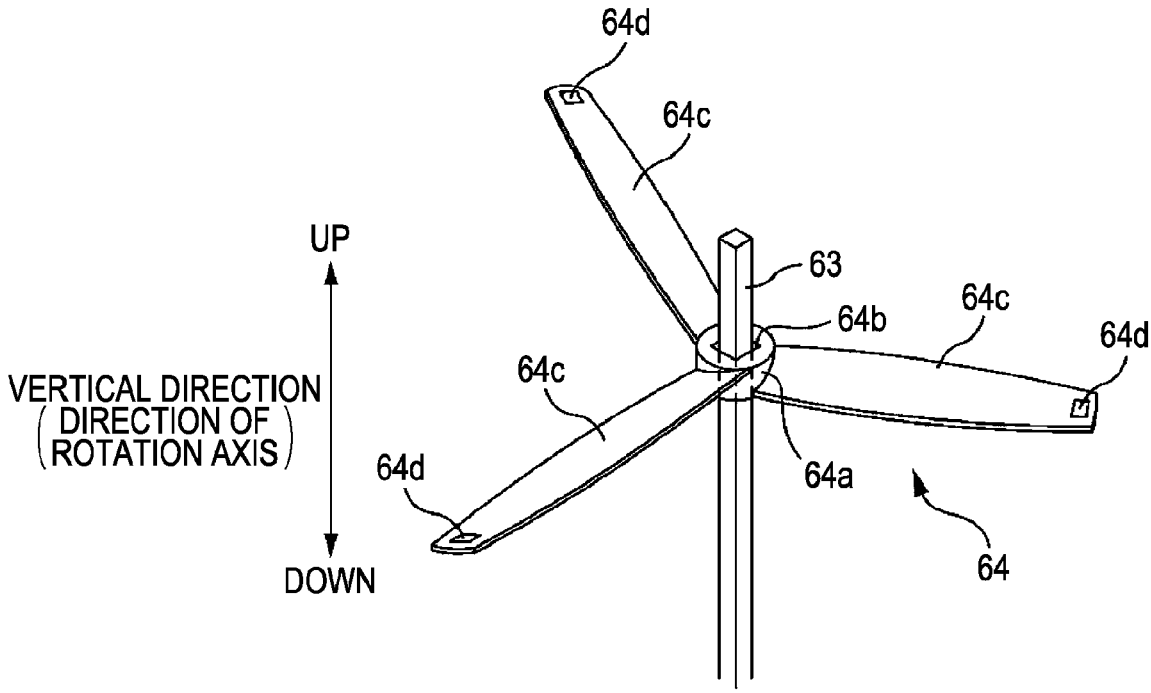
FIG. 6 is a schematic diagram showing a propeller member 64 that is installed to an angled shaft 63 according to an embodiment of the invention.
Figure 7A:
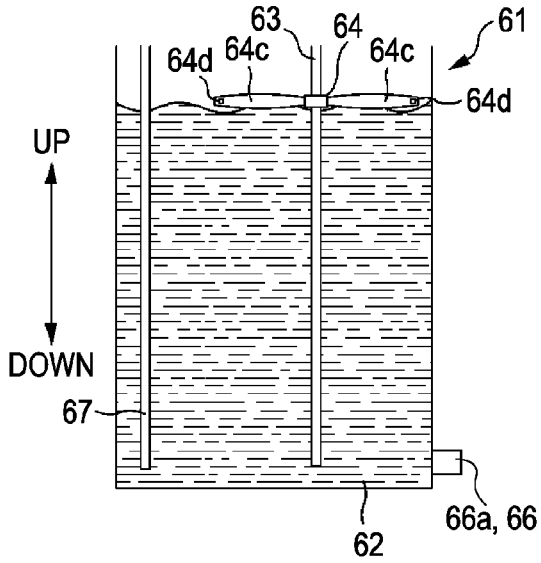
FIG. 7A is a diagram showing a state in which the propeller member 64 is positioned at a liquid surface.
Figure 7B:
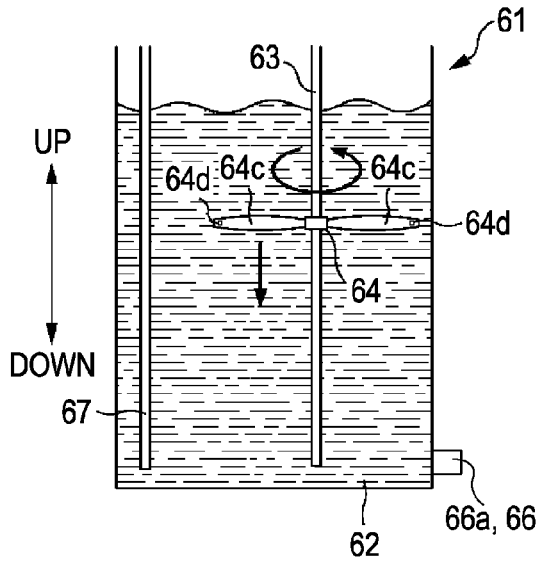
FIG. 7B is a diagram showing the propeller member 64 during its movement accompanied by rotation of the angled shaft 63.
Figure 7C:
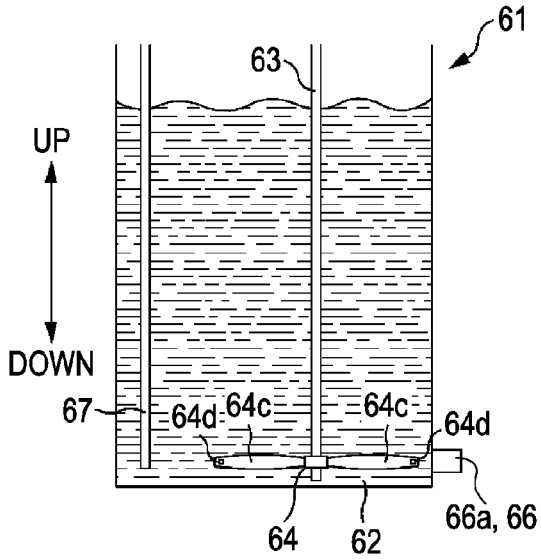
FIG. 7C is a diagram showing a state in which the propeller member 64 is moved to a detection position.
Figure 7D:
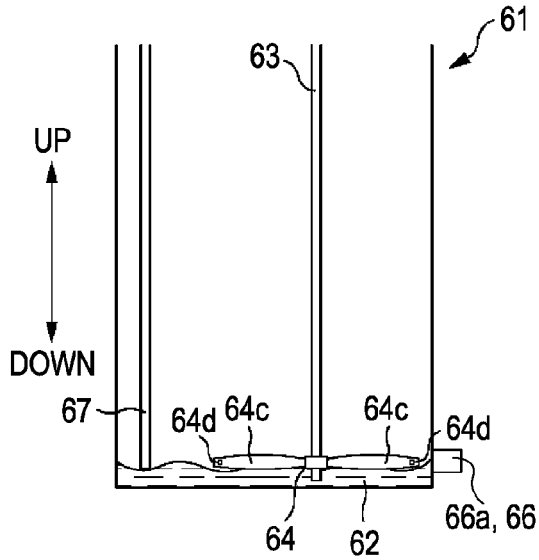
FIG. 7D is a diagram showing an ink cartridge 61 at the time of ink-end according to an embodiment of the invention.

FIG. 5 is a schematic diagram showing the configuration of the ink supplying unit 60. FIG. 6 is a schematic diagram showing a propeller member 64 that is installed to an angled shaft 63. FIG. 7A is a diagram showing a state in which the propeller member 64 is positioned at the liquid surface. FIG. 7B is a diagram showing the propeller member 64 during its movement accompanied by rotation of the angled shaft 63. FIG. 7C is a diagram showing a state in which the propeller member 64 is moved to a detection position. FIG. 7D is a diagram showing an ink cartridge 61 at the time of ink-end.

According to the ink supplying units 60 of this embodiment, the configurations of a plurality of the ink supplying units 60 that is installed for each color of ink (in other words, each ink supplying unit 60 supplies ink of a different color to a corresponding head 42) are the same. Thus, in descriptions below, a case of the ink supplying unit 60 that supplies yellow ink will be described as an example.

The ink supplying unit 60, as shown in FIG. 5, includes an ink cartridge 61 that is an example of a liquid storing cartridge, a supply path 67, a supply pump 68, and an air suction path 69. The ink cartridge 61 stores ink (here, yellow ink) that is supplied to the storage chamber 43 of the head unit 40. This ink cartridge 61 is configured to be detachably attached to a printer main body that is a main body of a liquid storing device. The supply path 67 connects the ink cartridge 61 and the storage chamber 43 and is used for allowing ink that is supplied from the ink cartridge 61 to the storage chamber 43 to flow. The supply pump 68 is a tube pump that is installed to the supply path 67 and sucks ink of the ink cartridge 61 and delivers the ink to the storage chamber 43. The air suction path 69 is used for sucking the air into the ink cartridge 61.

Next, the internal configuration of the ink cartridge 61 will be described. The ink cartridge 61 includes an ink storing section 62 that is an example of a storing unit, an angled shaft 63 that is an example of a rotation member, a propeller member 64 that is an example of a blade member, a motor 65, and a sensor 66 that is an example of a detection member.

The ink storing section 62 stores ink to be supplied to the head unit 43. The level of the ink inside the ink storing section 62 falls in accordance with supply (that is, consumption) of ink to the head unit 43. Then, until ink-end occurs, ink is supplied to the head unit 43. Here, the ink-end, as shown in FIG. 7D, means a state in which the amount of ink stored in the ink storing section 62 is very small (including a state in which the ink of the ink storing section 62 is depleted).

The angled shaft 63 is installed to the inside of the ink storing section 62 and rotates around the rotation axis. One end side of the angled shaft 63 in the direction of the rotation axis is connected to the motor 65. Accordingly, the motor 65 generates power for rotating the angled shaft 63.

The propeller member 64 is installed to the angled shaft 63 and thus, is rotated in accordance with rotation of the angled shaft 63. This propeller member 64, as shown in FIG. 7B, agitates ink when the propeller member 64 rotates and moves on the lower side of the liquid surface of the ink in the vertical direction. As described above, the propeller member 64 agitates the ink, and whereby sedimentation of ink inside the ink storing section 62 can be suppressed.

In addition, the propeller member 64, as shown in FIG. 6, includes a through hole 64*b* that is a hole part having a rectangular shape through which the angled shaft 63 perforates and a plurality of (in this embodiment, three) blades 64*c* that agitates the ink, and permanent magnets 64d that are magnets for generating magnetic fields.

The through hole 64*b* is positioned at the center of a base part 64*a*. Between the through hole 64*b* part of the propeller member 64 and the angled shaft 63, a small gap is formed such that the propeller member 64 can move with respect to the angled shaft 63 in the direction of the rotation axis. The blades 64*c* extend from the base part 64*a* and are positioned around the through hole 64*b*. The permanent magnets 64*d* are installed to the front ends of the blades 64*c*.

When the propeller member 64 is rotated in accordance with the rotation of the angled shaft 63, propelling forces are applied to the blades 64*c*. In this embodiment, the angled shaft 63 has a predetermined angle with respect to the liquid surface of ink inside the ink storing section 62. Accordingly, when the angled shaft 63 is rotated (forward rotation) in one direction, the propeller member 64 in the middle of forward rotation is configured to move downward due to the propelling forces applied to the blades 64*c*. On the other hand, when the angled shaft 63 is rotated (reverse rotation) in the other direction, the propeller member 64 in the middle of reverse rotation is configured to move upward due to the propelling forces.

The specific gravity of the propeller member 64 is smaller than that of the ink. Accordingly, when the propeller member 64 stops, as shown in FIG. 7A, not the above-described propelling force, but buoyancy of the ink is applied to the propeller member 64. Therefore, the propeller member 64 is positioned at the liquid surface of the ink.

The sensor 66 detects the propeller member 64 in a case where the propeller member 64 is located at a predetermined detection position (a position shown in FIG. 7C) in the vertical direction. In particular, the sensor 66 includes a hall element 66*a* that detects a magnetic field generated by the permanent magnet 64*d* in a case where the blade 64*c* approaches the hall element 66*a* (in particular, in a case where the blade 64*c* and the hall element 66*a* are in a same position in the vertical direction). When the hall element 66*a* detects a magnetic field, a current flows through the hall element 66*a*, and thereby the sensor 66 detects that the propeller member 64 is located at the detection position. The hall element 66*a* is installed to the outside of the ink storing section 62. In other words, the hall element 66*a* faces the propeller member 64 that is located at the detection position far from the wall.

According to this embodiment, detection of the remaining amount of the ink inside the ink storing section 62 and detection of the ink-end are performed by the sensor 66. Accordingly, the state of the ink inside the ink storing section 62 is acquired appropriately.

Here, the remaining amount of the ink can be determined as follows. The amount of the ink inside the ink storing section 62 that is located lower than the position of the sensor 66 in the vertical direction can be known in advance. In addition, the amount of the ink that is located from the liquid surface to the position of the sensor 66 in the vertical direction can be acquired based on a rotation time until the propeller member 64 located at the liquid surface is detected by the sensor 66 (a detailed process will be described later). The sum of the above-described two amounts can be determined as the remaining amount of the ink inside the ink storing section 62.

In addition, the ink-end can be determined as follows. According to this embodiment, the position of the sensor 66 is a position corresponding to an end part of the ink supplying path 67 in the vertical direction. When the liquid surface is located at the position of the sensor 66, ink does not flow through the ink supplying path 67, and accordingly, the amount of the ink inside the ink storing section 62 does not change. Therefore, a case where the liquid surface is located at the sensor 66 can be determined to be in correspondence with the ink-end.

Agitation Mode, Remaining Amount Detecting Mode, and Ink-End Detecting Mode

When time elapses in a state in which the ink inside the ink storing section 62 is not used, the ink may sink. Thus, in order to suppress sedimentation of the ink, the ink is needed to be agitated appropriately. In addition, as the ink is supplied to the head unit 40, the remaining amount of the ink inside the ink storing section 62 changes. Here, in order to perform supply of ink to the head unit 40 stably, it is needed to acquire the state of the ink including the remaining amount of the ink appropriately. In order to respond to such a request, the printer 1 performs operations corresponding to three modes that are prepared in advance.

As the above-described three modes, there are an agitation mode for agitating the ink inside the ink storing section 62, a remaining amount detecting mode for detecting the remaining amount of the ink inside the ink storing section 62, and an end detecting mode for detecting the ink-end. Hereinafter, the modes will be described in the order of the agitation mode, the remaining amount detecting mode, and the end detecting mode.

Agitation Mode

Figure 8:
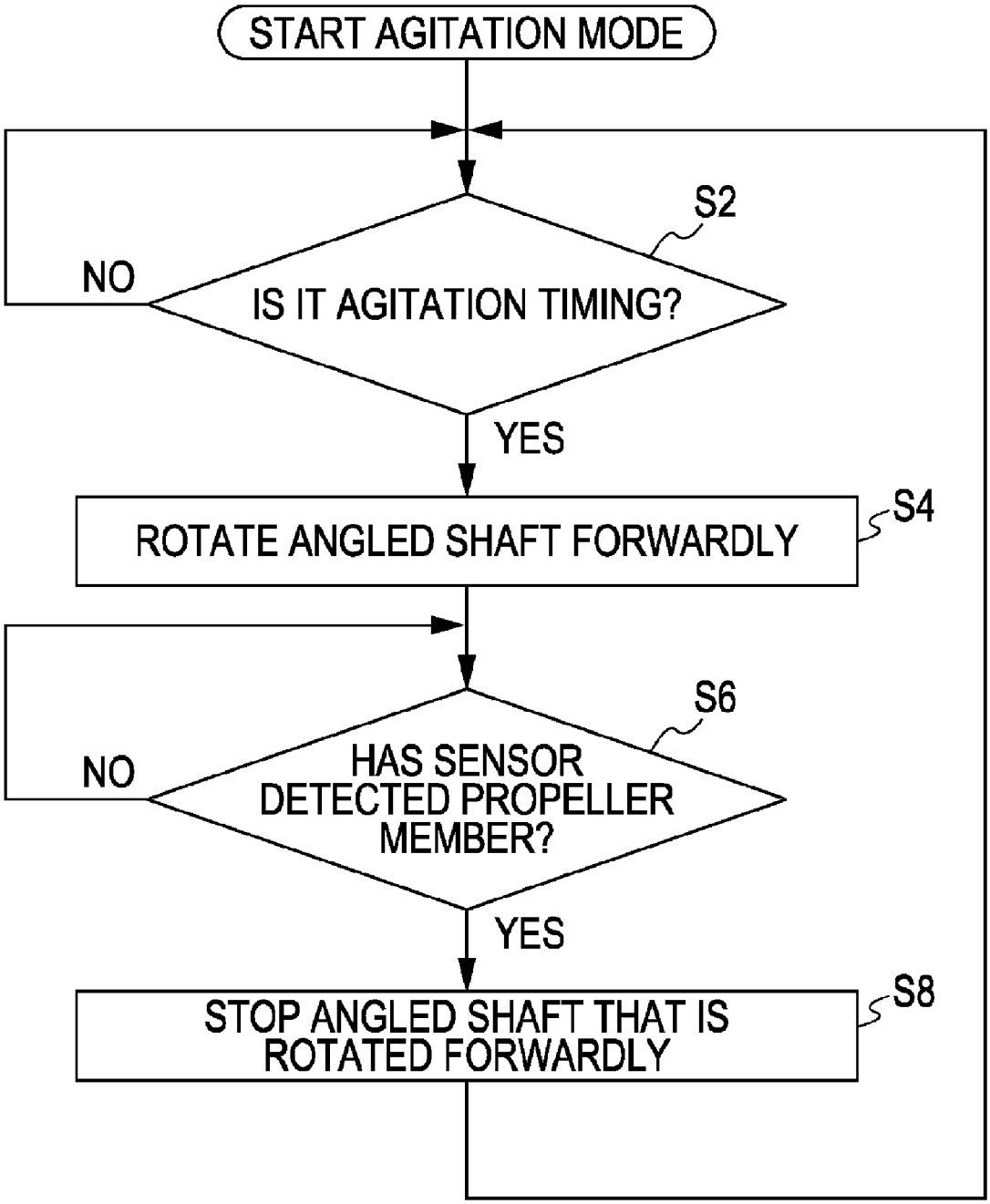
FIG. 8 is a flowchart showing an agitation mode according to an embodiment of the invention.

FIG. 8 is a flowchart showing the agitation mode.

The agitation mode is a mode in which the ink is agitated while the propeller member 64 located at the liquid surface is moved downward in the vertical direction.

Various operations of the printer 1 in the agitation mode are mainly performed by the controller 10 (this is the same in the remaining amount detecting mode and the end detecting mode). In particular, according to this embodiment, the CPU 12 executes a program that is stored in the memory 13, and whereby the operations are performed. The program is constituted by codes for performing the various operations described below.

The agitation mode is performed at a predetermined agitation timing. The agitation timing according to this embodiment, for example, is a timing when the power of the printer 1 is turned on or a timing when a predetermined time elapses after the previous ink agitation process is completed. In addition, as shown in FIG. 7A, the propeller member 64 is located at the liquid surface of the ink at the agitation timing.

First, when it is the agitation timing, for example, when the power of the printer 1 is turned on (Step S2: Yes), the controller 10 rotates the angled shaft 63 in one direction (forward rotation) by using the motor 65 (Step S4). In accordance with the forward rotation of the angled shaft 63, the propeller member 64 that is installed to the angled shaft 63 is also rotated forwardly in a state in which the angled shaft 63 perforates the through hole 64*b*.

Here, during forward rotation of the propeller member 64, a propelling force is generated by the blades 64*c*. This propelling force is applied to the propeller member 64, which is forwardly rotated, toward the lower side of the vertical direction. Accordingly, the propeller member 64 that is rotated forwardly, as shown in FIG. 7B, is moved toward the lower side of the vertical direction by the propelling force. Then, the ink located on the lower side of the liquid surface is agitated by the propeller member 64 that is in the movement. As described above, the propeller member 64 that is located at the liquid surface at the start of the agitation mode agitates the ink while it moves (rotates) toward the lower side of the liquid surface of the ink in the vertical direction along the direction of the rotation axis in accordance with forward rotation of the angled shaft 63.

Next, when the sensor 66 detects the propeller member 64 during the movement of the propeller member 64, as shown in FIG. 7C (that is, the sensor 66 detects the propeller member 64 located at the detection position) (Step S6: Yes), the controller 10 stops the angled shaft 63 that is forwardly rotated (Step S8). Accordingly, the forward rotation of the propeller member 64 is also stopped (in other words, the propeller member 64 is forwardly rotated until the propeller member 64 is moved to the detection position).

When the forward rotation of the angled shaft 63 is stopped, the above-described propelling force is not applied. Then, as described above, since the specific gravity of the propeller member 64 is smaller than that of the ink, the propeller member 64 that is located at the detection position is moved (that is, floats) toward the liquid surface by the buoyancy of the ink. As a result, when a predetermined time elapses after stop of rotation of the angled shaft 63, the propeller member 64, as shown in FIG. 7A, is located at the liquid surface.

Thereafter, when it is the agitation timing (when a predetermined time elapses after agitation of the ink is completed), the above-described operations (Steps S2 to S8) are performed, and thereby the ink inside the ink storing section 62 is agitated.

In the above-described agitation mode, agitation of the ink is continuously performed by the propeller member 64 during the forward rotation of the angled shaft 63, and accordingly, sedimentation of the ink inside the ink storing section 62 is suppressed effectively.

In the description above, the timing for stopping the angled shaft 63 that is forwardly rotated is a time when the sensor 66 detects the propeller member 64. However, the invention is not limited thereto. For example, it may be configured that the angled shaft 63 is stopped after the angled shaft 63 is rotated for a predetermined time.

In addition, in the description above, the propeller member 64 is configured to be moved to the liquid surface by the buoyancy of the ink after the forward rotation of the angled shaft 63 is stopped. However, the invention is not limited thereto. For example, it may be configured that the angled shaft 63 is reversely rotated so as to move the propeller member 64 to the liquid surface after stop of the forward rotation of the angled shaft 63. Accordingly, in such a case, the ink is agitated by the propeller member 64 until the propeller member 64 is moved from the detection position to the liquid surface.

Remaining Amount Detecting Mode

Figure 9:
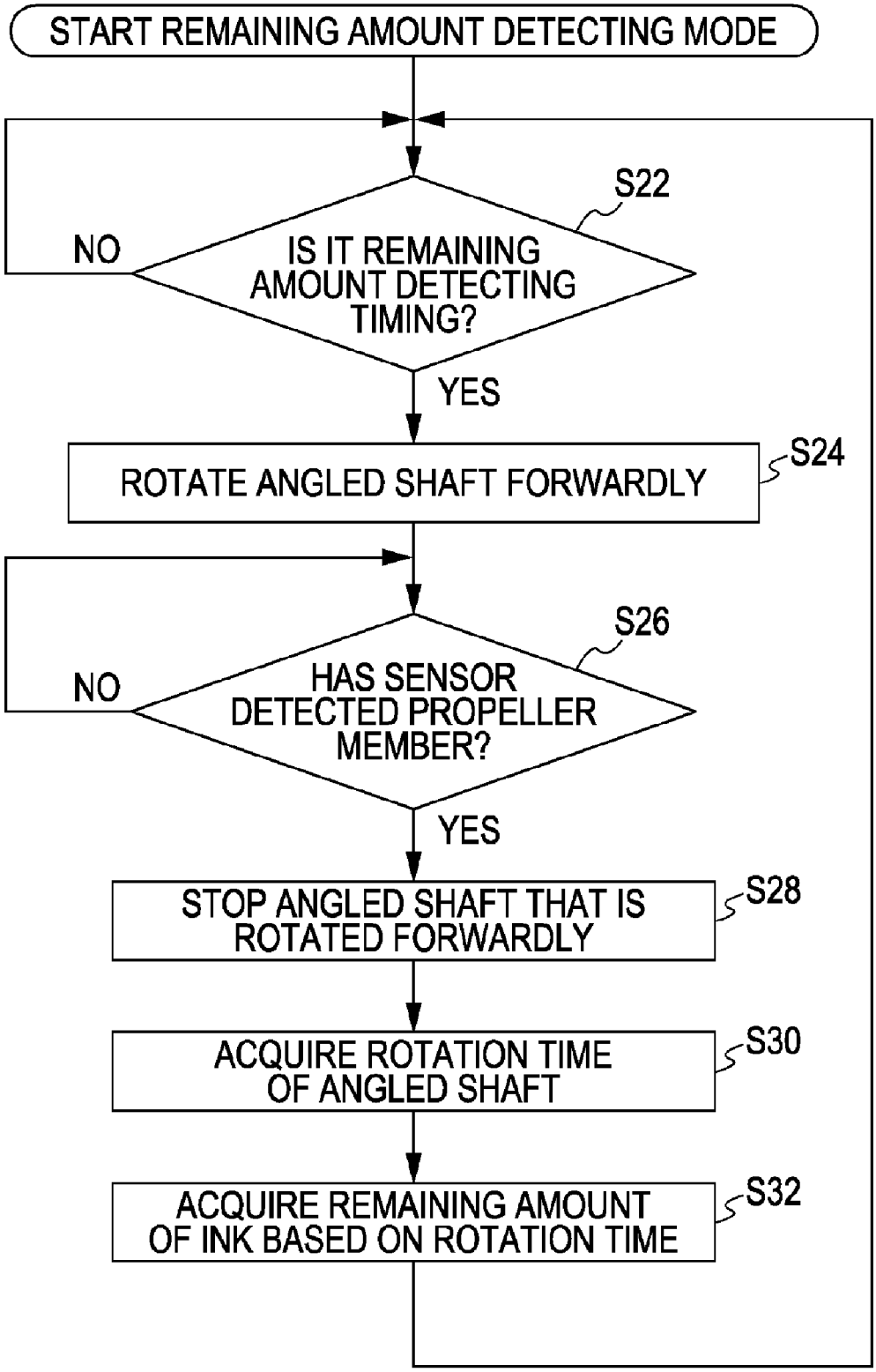
FIG. 9 is a flowchart showing the remaining amount detecting mode.

FIG. 9 is a flowchart showing the remaining amount detecting mode.

The remaining amount detecting mode is a mode for detecting the remaining amount of ink inside the ink storing section 62 by moving the propeller member 64 located at the liquid surface to the lower side of the vertical direction and having the propeller member 64 to be detected by the sensor 66.

The remaining amount detecting mode, similarly to the agitation mode, is performed at a predetermined remaining amount detecting timing. The remaining amount detecting mode according to this embodiment, for example, is performed at a timing when the power of the printer 1 is turned on or a timing when a predetermined time elapses after completion of the previous detection of the remaining amount of ink. When it is the remaining amount detecting timing, the propeller member 64, as shown in FIG. 7A, is located at the liquid surface of the ink.

First, when it is the remaining amount detecting timing, for example, when the power of the printer 1 is turned on (Step S22: Yes), the controller 10 forwardly rotates the angled shaft 63 by using the motor 65 (Step S24). The propeller member 64 is forwardly rotated in accordance with the forward rotation of the angled shaft 63. Then, the propeller member 64 that is rotated forwardly is moved toward the lower side of the vertical direction as shown in FIG. 7B by the above-described propelling force. In addition, agitation of the ink is performed while the propeller member 64 is moved (moved with rotation).

Next, when the sensor 66 detects the propeller member 64 (in other words, when the sensor 66 detects the propeller member 64 located at the detection position) (Step S26: Yes), as shown in FIG. 7C, during movement of the propeller member 64, the controller 10 stops the angled shaft 63 that is rotated forwardly (Step S28). Accordingly, the forward rotation of the propeller member 64 is stopped. In addition, when a predetermined time elapses after stop of rotation of the angled shaft 63, the propeller member 64 floats by the buoyancy of the ink to be located at the liquid surface (FIG. 7A).

Next, the controller 10 acquires a rotation time (that is, a rotation time of the propeller member 64 until the propeller member 64 located at the liquid surface moves to the detection position) of the angled shaft 63 from start of the forward rotation in Step S24 to stop of the forward rotation in Step S28 by using the timer 15 (FIG. 1) (Step S30). Then, the controller 10 acquires the remaining amount of the ink inside the ink storing section 62 based on the acquired rotation time (Step S32).

Here, relationship between the rotation time of the angled shaft 63 and the remaining amount of ink is measured in an experiment or the like in advance, and information on the relationship, for example, is stored in the memory 13. Accordingly, the controller 10 can acquire (detect) the remaining amount of the ink inside the ink storing section 62 by comparing the acquired rotation time with the information stored in the memory 13.

Thereafter, when it is a remaining amount detecting timing (when a predetermined time elapses after completion of detection of the remaining amount of the ink), the above-described operations (Steps S22 to S32) are performed, and thereby the remaining amount of the ink inside the ink storing section 62 is detected.

In the above-described remaining amount detecting mode, the controller 10 acquires the amount of the ink inside the ink storing section 62 based on the time from start of the forward rotation of the angled shaft 63 to detection of the propeller member 64, which is moved to the detection position, by using the sensor 66. Accordingly, the remaining amount of the ink can be detected by using a simple method.

In addition, since Steps S4 to S8 of the agitation mode and Steps S24 to S28 of the remaining amount detecting mode are the same, the two modes may be performed simultaneously. In such a case, the control time can be shortened, compared to a case where the two modes are performed separately.

Ink-End Detecting Mode

Figure 10:
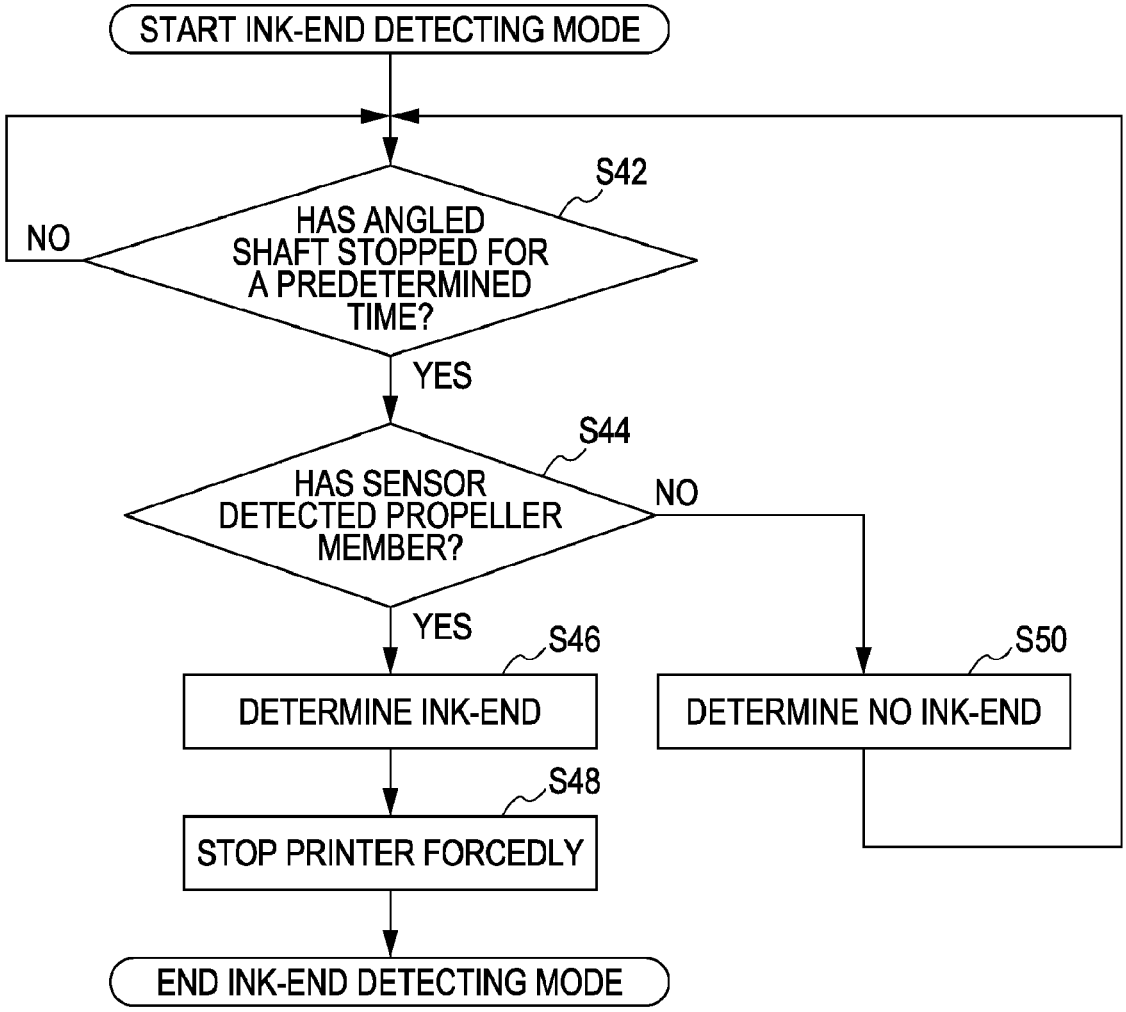
FIG. 10 is a flowchart showing an ink-end detecting mode according to an embodiment of the invention.

FIG. 10 is a flowchart showing the ink-end detecting mode.

The ink-end detecting mode is a mode for determining that the state of the ink inside the ink storing section 62 is the ink-end in a case where the propeller member 64 located at the liquid surface is detected by the sensor 66 (that is, a case where the liquid surface of the ink is detected).

The ink-end detecting mode according to this embodiment is performed when the above-described agitation mode or the remaining amount detecting mode is not performed. In particular, when the angled shaft 63 is stopped for a predetermined time (Step S42: Yes), the ink-end detecting mode is performed. The reason is that, when the angled shaft 63 is stopped for a predetermined time or more, the propeller member 64 to which the buoyancy of the ink is applied can be determined to be located at the liquid surface or not, assuredly. Accordingly, in a case where this mode is performed, when the propeller member 64 located at the liquid surface is detected, the position of the liquid surface of the ink can be acquired.

The controller 10 determines that the ink is in the ink-end state in a case where the propeller member 64 located at the liquid surface is detected by the sensor 66 (that is, a case where the propeller member 64 is located at the detection position) (Step S44: Yes) (Step S46). In other words, the controller 10, as shown in FIG. 7D, determines that there is little remaining amount of the ink inside the ink storing section 62 and there is little ink to be supplied to the head unit 40.

The controller 10 that has determined that the ink is in the ink-end state stops the operated printer 1 forcedly (Step S48). Accordingly, it can be prevented that ink discharge from the head 42 is performed in a state in which the ink is depleted.

On the other hand, the controller 10 determines that the ink is not in the ink-end state in a case where the propeller member 64 that is located at the liquid position is not detected by the sensor 66 (that is, a case where the propeller member 64 is located on the upper side of the detection position in the vertical direction) (Step S44: No) (Step S50). In other words, the controller 10 determines that ink to be supplied to the head unit 40 is stored in the ink storing section 62.

In such a case, detection of the ink-end is continuously performed thereafter. In other words, the operations in Steps S42 and S44 are repeatedly performed until the ink-end is detected.

In the above-described ink-end detecting mode, in a state in which the angled shaft 63 is stopped and the propeller member 64 is located at the liquid surface, when the propeller member 64 located at the liquid surface is detected by the sensor 66, the controller 10 determines that the remaining amount of the ink inside the ink storing section 62 is equal to or smaller than a predetermined amount. Accordingly, the ink-end can be detected by using a simple method.

Effectiveness of Printer 1 According to This Embodiment

As described above, the printer 1 (liquid storing device) according to this embodiment includes: (a) an ink storing section 62 (storage unit) that stores ink (liquid) to be consumed; (b) an angled shaft 63 (rotation member) that is installed to the inside the ink storing section 62 and is rotated around the rotation axis; (c) a propeller member 64 (blade member) that is installed to the angled shaft 63 so as to be movable with respect to the angled shaft 63 in the direction of the rotation axis and has specific gravity that is smaller than that of the ink, wherein the propeller member 64 agitates the ink while moving toward the lower side of the liquid surface of the ink in the vertical direction in accordance with rotation of the angled shaft 63, in a case where the angled shaft 63 is forwardly rotated (rotated in one direction), and the propeller member 64 floats toward the liquid surface by buoyancy of the ink at a time when the forward rotation of the angled shaft 63 stops; and (d) a sensor 66 (detection member) that detects the propeller member 64 in a case where the propeller member 64 is located at the detection position in the vertical direction. Accordingly, under a simple structure, the ink inside the ink storing section 62 can be agitated appropriately, and the state of the ink inside the ink storing section 62 can be detected appropriately.

In other words, the propeller member 64 that is moved (moved with rotation) to the lower side of the liquid surface in the vertical direction in accordance with the forward rotation of the angled shaft 63 agitates the ink located on the lower side of the liquid surface approximately evenly while being rotated in the movement. Accordingly, although a simple structure is used, the ink inside the ink storing section 62 can be agitated appropriately.

In addition, the specific gravity of the propeller member 64 is smaller than that of the ink, and thus, when the angled shaft 63 is not rotated, the propeller member 64 is located at the liquid surface due to the buoyancy of the ink. Accordingly, the position of the liquid surface can be detected by detecting the propeller member 64 that is located at the liquid surface. In addition, by detecting the propeller member 64 that is moved in accordance with the forward rotation of the angled shaft 63, the remaining amount of the ink can be detected. As a result, by using a simple structure, the state of the ink inside the ink storing section 62 can be detected appropriately.

In addition, the ink is ultraviolet curable ink, and it is configured that the propeller member 64 includes permanent magnets 64*d* (magnets) that generate magnetic fields. The sensor 66 includes the hall element 66*a* that detects a magnetic field generated by the permanent magnet 64*d* in a case where the permanent magnet 64*d* approaches the sensor 66. When the hall element 66*a* detects the above-described magnetic field, it is detected that the propeller member 64 is located at the detection position (see FIG. 7C and the like). In such a case, as described below, even when the ultraviolet curable ink is used, the sensor 66 can appropriately detect the propeller member 64.

In other words, when the ink inside the ink storing section 62 is the ultraviolet curable ink (ink through which light cannot be easily transmitted), it is difficult to detect the propeller member 64, for example, by using a photo sensor. To the contrary, in a case where the hall element 66*a* and the permanent magnet 64*d* are configured (the case of this embodiment), even when the ultraviolet curable ink is used, a current flows through the hall element 66*a* that detects the magnetic field that is generated by the permanent magnet 64*d*. Accordingly, the sensor 66 can detect the propeller member 64 appropriately.

In addition, the propeller member 64, as shown in FIG. 6, is configured to have the through hole 64*b* (hole part) having a rectangular shape through which the angled shaft 63 perforates and a blade 64*c* that is installed to the periphery of the through hole 64*b* and agitates the ink. When the angled shaft 63 is rotated forwardly, the angled shaft 63 is rotated in a state in which the angled shaft 63 is brought into contact with the through hole 64*b*, and thereby the propeller member 64 agitates the ink while moving to the lower side of the liquid surface (see FIG. 7B). On the other hand, when the forward rotation of angled shaft 63 stops, the propeller member 64 floats towards the liquid surface due to the buoyancy of the ink in a state in which the angled shaft 63 perforates the through hole 64*b*.

In such a case, by using a simple structure, the propeller member 64 can be moved (moved with rotation) toward the lower side of the liquid surface in the vertical direction during the forward rotation of the angled shaft 63, and the propeller member 64 can float toward the liquid surface at a time when the forward rotation of the angled shaft 63 stops.

Second Embodiment

The configuration of an ink supplying unit 60 according to a second embodiment of the invention which is different from that according to the above-described embodiment (hereinafter, referred to as a first embodiment) will now be described. In addition, the above-described three modes (the agitation mode, the remaining amount detecting mode, and the ink-end detecting mode) will be described.

Configuration of Ink Supplying Unit 60

Figure 11A:
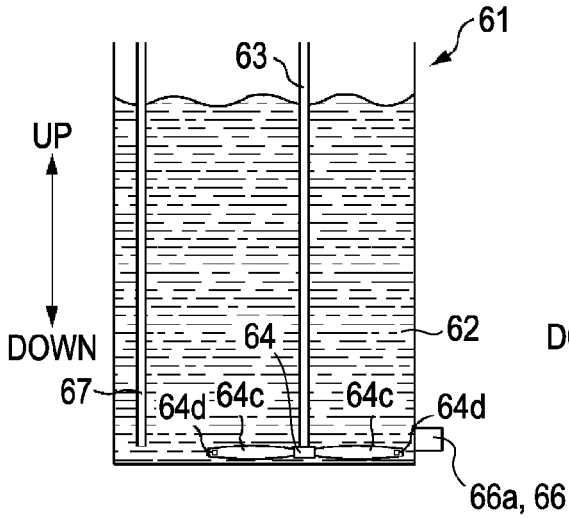
FIGS. 11A to 11F are schematic diagrams showing an ink supplying unit 60 according to a second embodiment of the invention.
Figure 11B:
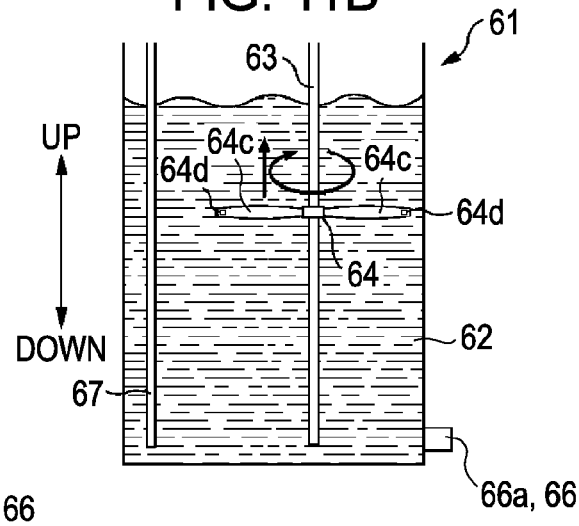
Figure 11C:
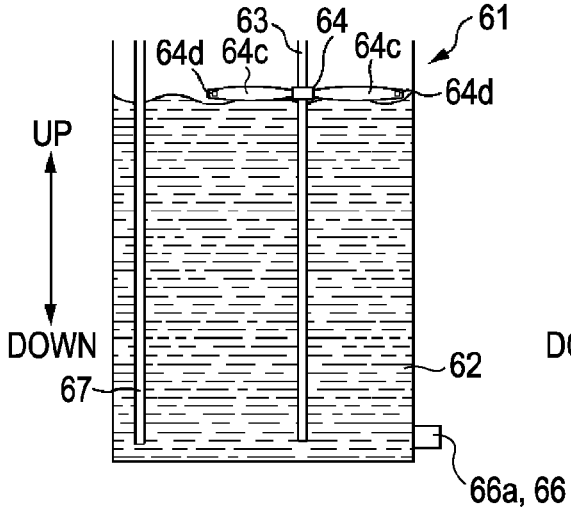
Figure 11D:
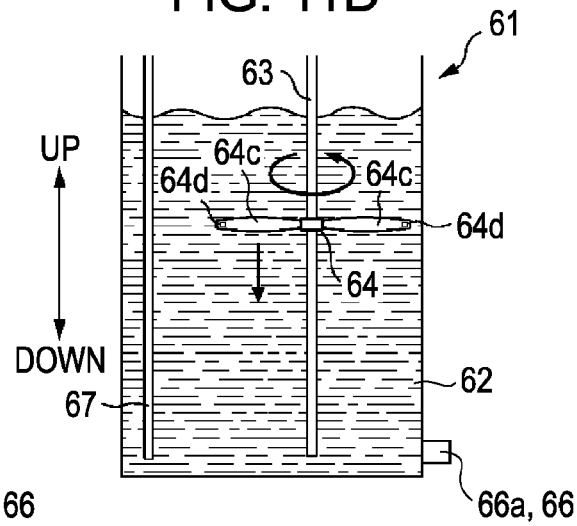
Figure 11E:
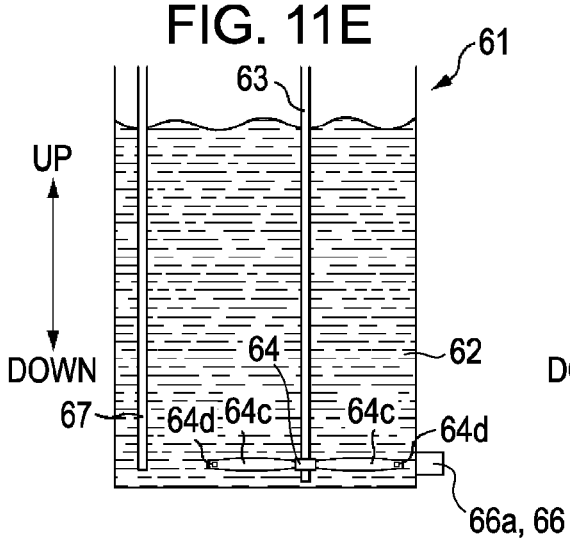

FIGS. 11A to 11F are schematic diagrams showing the ink supplying unit 60 according to the second embodiment. FIG. 12 is a perspective view of a propeller member 64 according to the second embodiment. In FIGS. 11A to 11F, the propeller member 64 is simplified.

The configuration of the propeller member 64 according to the second embodiment is different from that according to the first embodiment. On the other hand, configurations other than the configuration of the propeller member 64 are the same in the two embodiments. Thus, hereinafter, the configuration of the propeller member 64 will be mainly described, and descriptions for the configurations other than the configuration of the propeller member 64 will be omitted here.

The propeller member 64 is installed to the angled shaft 63, and, as shown in FIGS. 11A to 11F, the propeller member 64 is rotated to move in the vertical direction in accordance with rotation of the angled shaft 63. The propeller member 64, as shown in FIG. 12, includes a base part 64*a*, a plurality of blades 64*c*, a connection part 64*e*, and permanent magnets 64*d*.

On the center side of the base part 64*a*, a through hole 64*b* through which the angled shaft 63 perforates is formed. The plurality of blades 64*c* (twelve blades 64*c*) extends from the base part 64*a* in a radial pattern. The number of the blades 64*c* is larger than that of the first embodiment. The connection part 64*e* forms a circular shape and connects the front end portions of the plurality of the blades 64*c*. Accordingly, the strength of the propeller member 64 increases. A plurality of (twelve) the permanent magnets 64*d* is installed on the outer circumference of the connection part 64*e* with equally spaced and is a detection part that is detected by the sensor 66. The permanent magnets 64*d* of the propeller member 64 are magnetic bodies, and other parts thereof (the base part 64*a* and the like) are non-magnetic bodies.

According to the first embodiment, the specific gravity of the propeller member 64 is configured to be smaller than that of the ink. However, according to the second embodiment, the specific gravity of the propeller member 64 is configured to be larger than that of the ink. Accordingly, when the angled shaft 63 is not rotated, the propeller member 64, as shown in FIG. 11A, is located at the bottom face of the ink storing section 62.

Here, the material of the propeller member 64 is a resin such as polycarbonate (specific gravity: 1.2) and polyvinyl chloride (specific gravity: 1.2 to 1.5) or metal such as aluminum (specific gravity: 2.7). The propeller member 64 is manufactured by performing vacuum forming for the resin or performing cutting work for the metal.

As a solvent of the ink (liquid), water is used. Thus, about 80% of the ink is water, and about remaining 20% is an ink solid content (pigment and the like) (same in the first embodiment). In other words, water is dominant for the specific gravity of the ink. Accordingly, by using the above-described material as the propeller member 64, the specific gravity of the propeller member 64 is larger than that of the ink.

In addition, the material of the propeller member 64 according to the first embodiment is a resin such as polyethylene (specific gravity: 0.91 to 0.96), non-oriented polypropylene (specific gravity: 0.88 to 0.90). Accordingly, the specific gravity of the propeller member 64 according to the first embodiment is smaller than that of the ink in which water is a dominant content.

Agitation Mode, Remaining Amount Detecting Mode, and Ink-End Detecting Mode

According to the second embodiment, the above-described three modes (the agitation mode, the remaining amount detecting mode, and the ink-end detecting mode) are performed. Hereinafter, the modes will be described.

Agitation Mode

Figure 13:
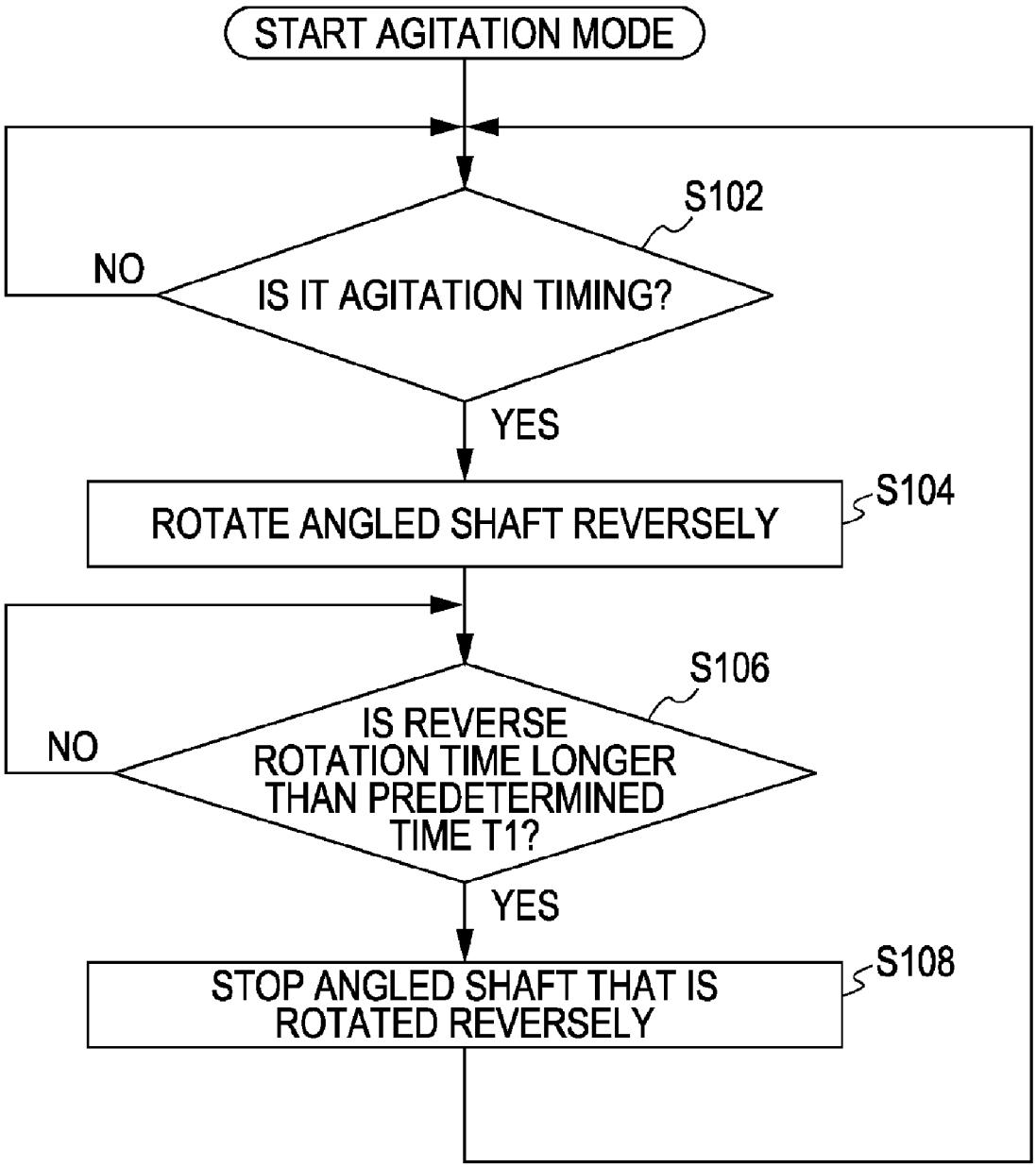
FIG. 13 is a flowchart showing an agitation mode according to the second embodiment.

FIG. 13 is a flowchart showing the agitation mode. When the agitation mode is started, the propeller member 64 that has the specific gravity larger than that of the ink is located at the bottom face of the ink storing section 62, as shown in FIG. 11A.

First, the controller 10 rotates the angled shaft 63 reversely by using the motor 65 when it is the above-described agitation timing (Step S102: Yes) (Step S104). In accordance with the reverse rotation, the propeller member 64 is moved (moved with rotation) toward the upper side by the above-described propelling force, as shown in FIG. 11B. Then, the propeller member 64 agitates the ink inside the ink storing section 62 during it is moved with rotation.

Next, the controller 10 determines whether the reverse rotation time of the angled shaft 63 is longer than a predetermined time T1 (Step S106). Here, the predetermined time T1 is a value that can be acquired from an experiment or the like in advance and is a time (estimated time) required for the propeller member 64 located at the bottom face of the ink storing section 62 to reach the liquid surface of the ink assuredly in accordance with the rotation of the angled shaft 63.

When the reverse rotation time is longer than the predetermined time T1 (Step S106: Yes), the controller 10 determines that the propeller member 64 is located at the liquid surface as shown in FIG. 11C and thus, stops the reverse rotation of the angled shaft 63 (Step S108). Accordingly, agitation of the ink is completed.

As described above, the specific gravity of the propeller member 64 is larger than that of the ink. Thus, when the rotation of the angled shaft 63 stops, the propeller member 64 is moved toward the lower side as shown in FIG. 11D. Then, the propeller member 64 that is moved to the lower side is located at the bottom face of the ink storing section 62 (see FIG. 11A).

In the above-description, the reverse rotation of the angled shaft 62 is configured to stop after the propeller member 64 is moved to the liquid surface. However, the invention is not limited thereto. For example, it may be configured that the angled shaft 62 is rotated forwardly after the propeller member 64 is located at the liquid surface. In such a case, the propeller member 64 agitates the ink while being rotated to move toward the lower side in accordance with forward rotation of the angled shaft 62. Accordingly, in that case, agitation of the ink inside the ink storing section 62 is promoted.

Remaining Amount Detecting Mode

Figure 14:
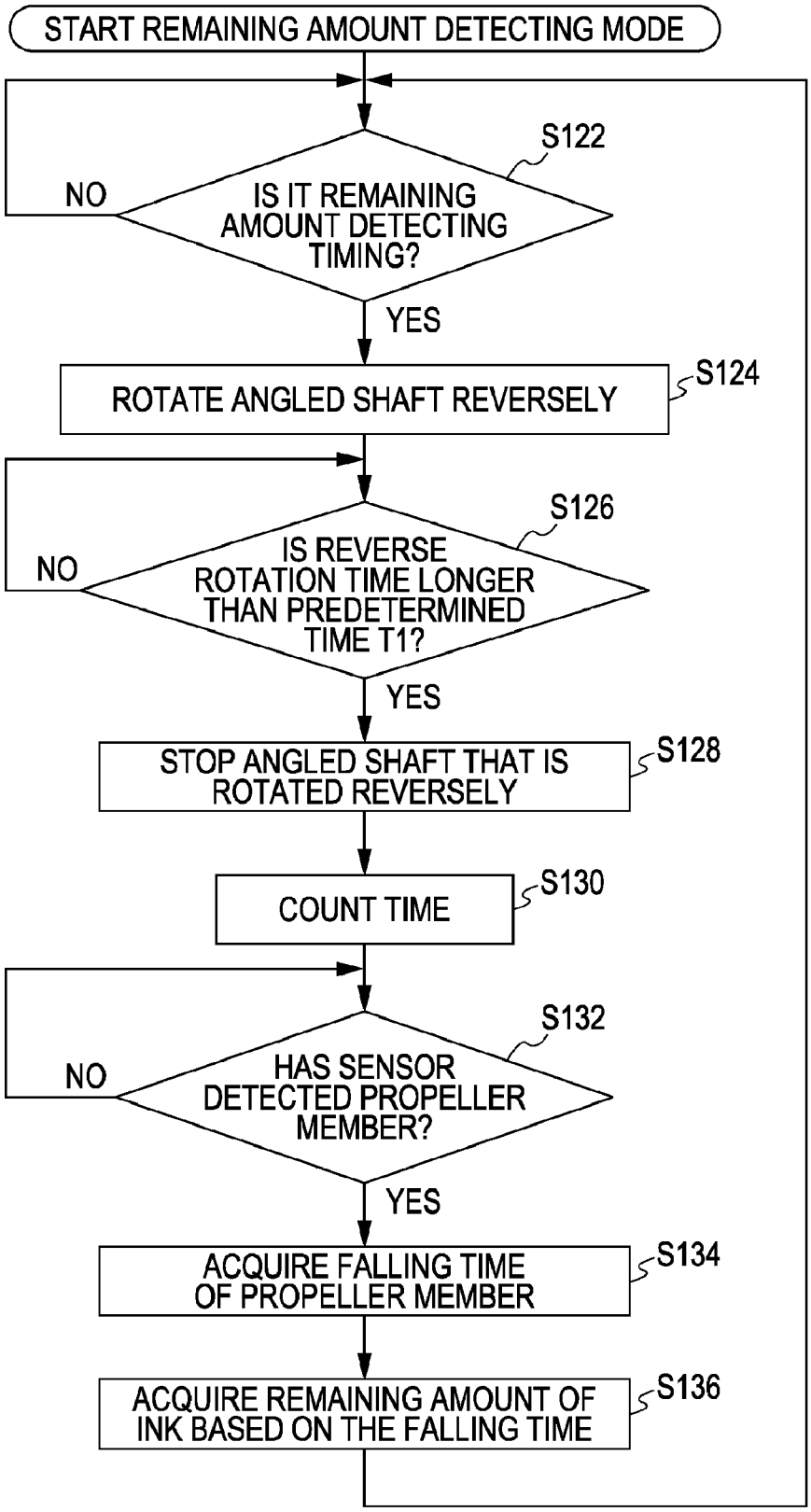
FIG. 14 is a flowchart showing a remaining amount detecting mode according to the second embodiment.

FIG. 14 is a flowchart showing the remaining amount detecting mode. When the remaining amount detecting mode is started, the propeller member 64 is located at the bottom face of the ink storing section 62 as shown in FIG. 11A.

First, when it is the above-described remaining amount detecting timing (Step S122: Yes), the controller 10 rotates the angled shaft 63 reversely (Step S124). In accordance with the reverse rotation, the propeller member 64 is moved (moved with rotation) toward the upper side by the above-described propelling force as shown in FIG. 11B.

Next, when the reverse rotation time of the angled shaft 63 is longer than a predetermine time T1 (Step S126: Yes), the controller 10 determines that the propeller member 64 is located at the liquid surface as shown in FIG. 11C and stops the reverse rotation of the angled shaft 63 (Step S128). Then, the controller 10 counts a time from a timing when the rotation of the angled shaft 63 is stopped by using the timer 15 (FIG. 1) (Step S130).

As described above, the specific gravity of the propeller member 64 is larger than that of the ink. Thus, when the rotation of the angled shaft 63 is stopped, the propeller member 64, as shown in FIG. 11D, is moved toward the lower side. Then, the propeller member 64 that is moved to the lower side is detected by the sensor 66 when the propeller member 64 is located at the detection position shown in FIG. 11E (Step S132: Yes).

Then, the controller 10 acquires a time (hereinafter, referred to as a falling time) from when the propeller member 64 moved to the liquid surface starts moving to the lower side of the vertical direction (that is, a timing when the reverse rotation of the angled shaft 63 is stopped) to when the propeller member 64 during its movement to the lower side is detected by the sensor 66, by using the timer 15 (Step S134).

Next, the controller 10 acquires the remaining amount of the ink inside the ink storing section 62 based on the acquired falling time (Step S136). In particular, information representing relationship (this relationship is acquired from an experiment or the like) between the falling time and the remaining amount of the ink is stored in the memory 13 (FIG. 1) or the like in advance. Accordingly, the controller 10 acquires the remaining amount of the ink by comparing the acquired falling time with the information.

As described above, according to the second embodiment, the controller 10 acquires the remaining amount of the ink inside the ink storing section 62 by having the propeller member 64 during its movement to the lower side to be detected by the sensor 66 at a time when the propeller member 64 is moved to the lower side after being moved to the upper side. Accordingly, the remaining amount of the ink can be detected appropriately without disposing a level sensor.

In the description above, the remaining amount of the ink is detected based on the falling time of the propeller member 64. However, the invention is not limited thereto. For example, the controller 10 may be configured to acquire the amount of the ink inside the ink storing section 62 based on the amount of rotation of the motor 65 until the propeller member 64 during its movement to the lower side is detected by the sensor 66 after the propeller member 64 moved to the upper side of the vertical direction starts moving to the lower side. Alternatively, the amount of rotation of the motor 65 may be acquired by an encoder (not shown) attached to the motor 65. The information representing the relationship between the amount of rotation of the motor 65 and the remaining amount of the ink is stored in the memory 13.

Ink-End Detecting Mode

Figure 15:
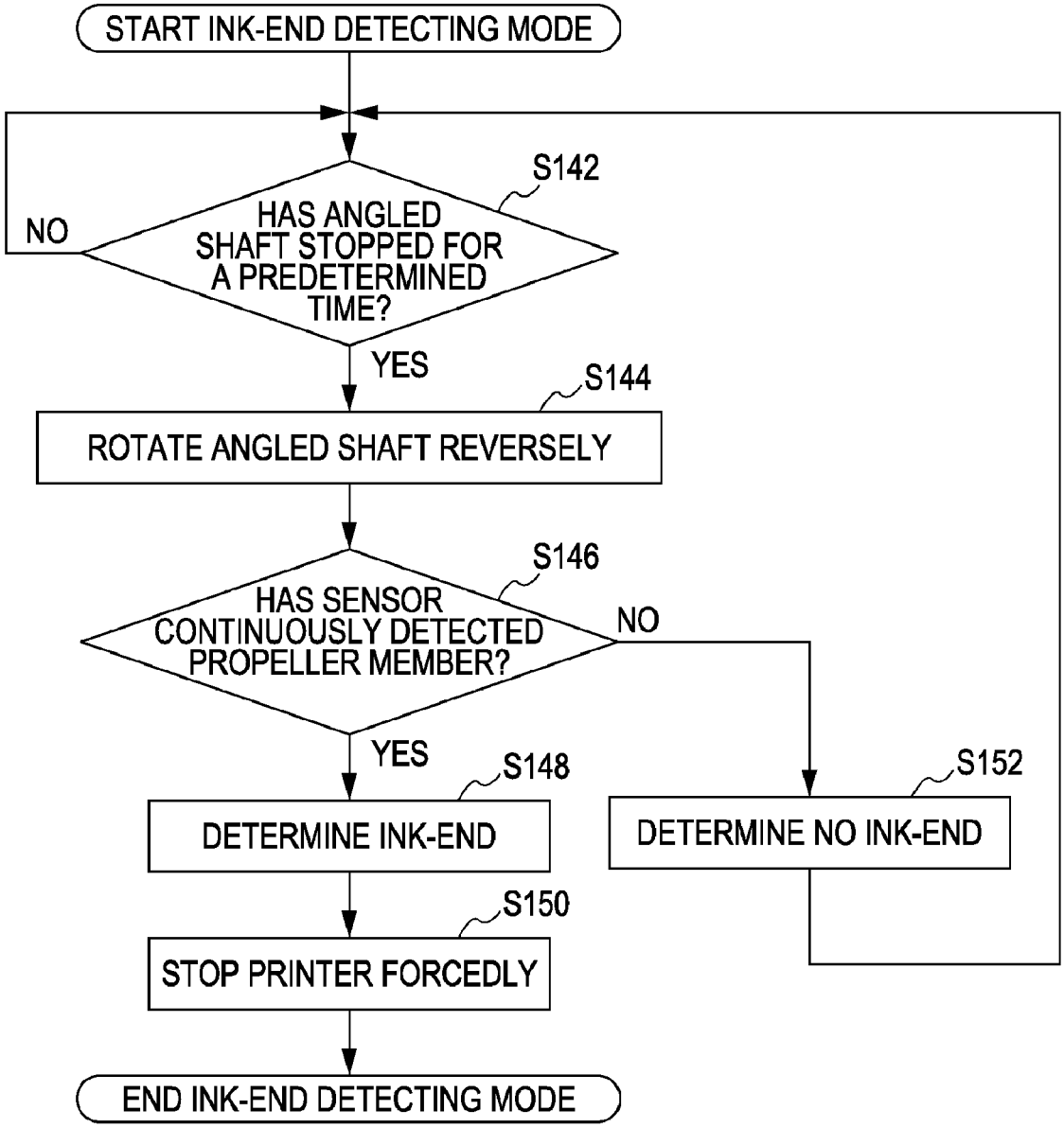
FIG. 15 is a flowchart showing an ink-end detecting mode according to the second embodiment.

FIG. 15 is a flowchart showing the ink-end detecting mode.

The ink-end detecting mode is performed when the angled shaft 63 is stopped for a predetermined time (this predetermined time is a time for assuming that the propeller member 64 is located at the bottom face of the ink storing section 62 assuredly) (Step S142: Yes).

First, the controller 10 rotates the angled shaft 63 reversely (Step S144). In accordance with the reverse rotation, the propeller member 64 is moved (moved with rotation) toward the liquid surface by the above-described propelling force. Then, the moved propeller member 64 does not move to the upper side of the liquid surface and is located at the liquid surface.

Figure 11F:
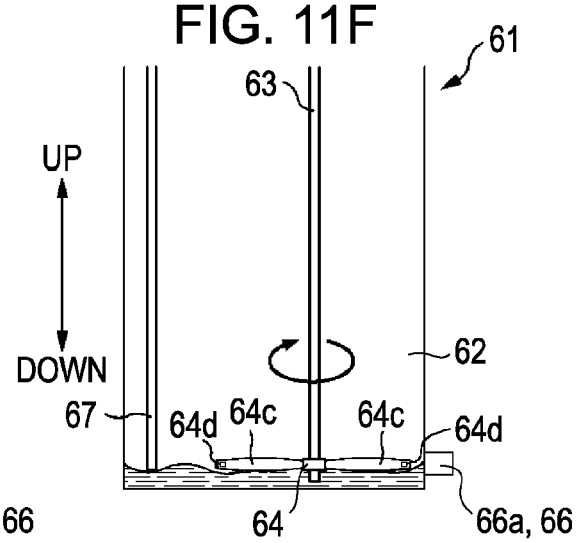
Figure 12:
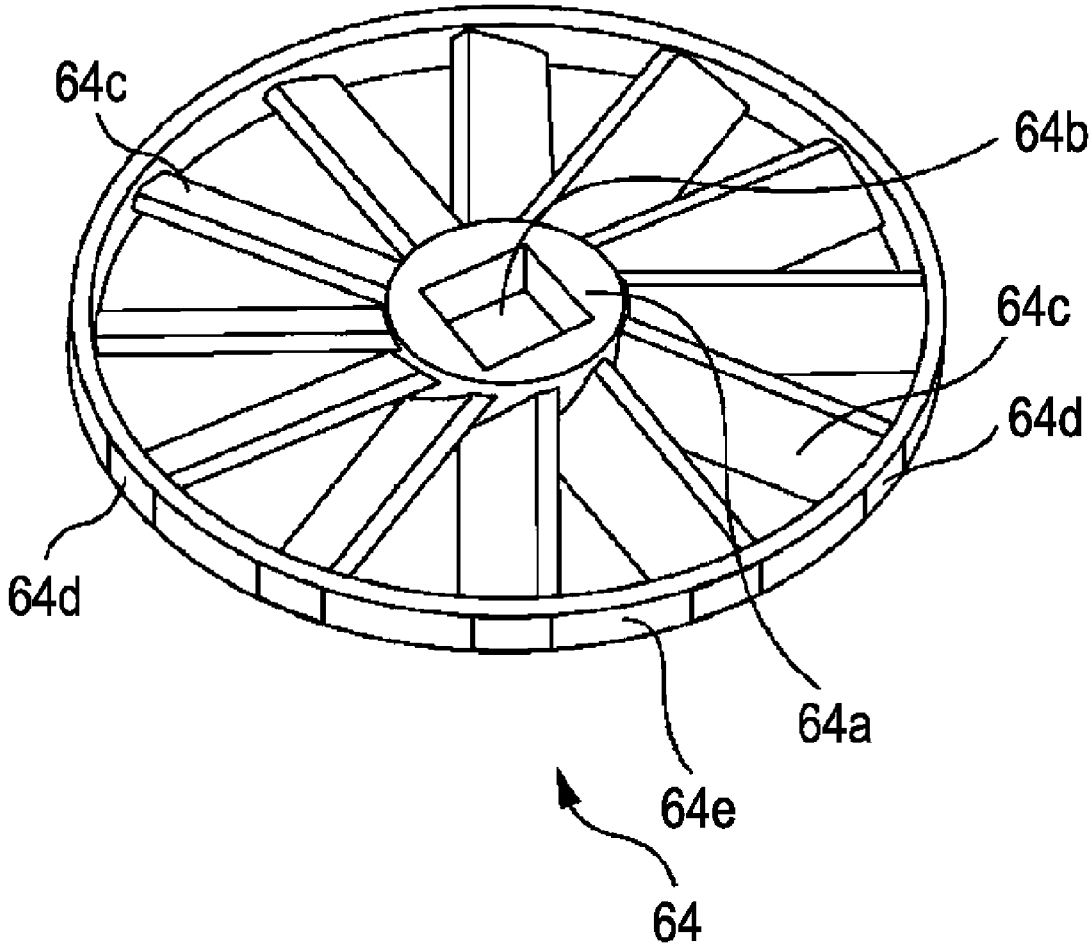
FIG. 12 is a perspective view of a propeller member 64 according to the second embodiment.

Here, when the remaining amount of the ink corresponds to the ink-end (as shown in FIG. 11F, the amount of the ink inside the ink storing section 62 is small, and the level of the ink has an almost same height as that of the sensor 66), the propeller member 64 right after the movement with rotation is detected by the sensor 66. In addition, the propeller member 64 for the case of depletion of the ink is also detected by the sensor 66.

However, the reverse rotation of the angled shaft 63 is performed only for a predetermined time T1 (in other words, after the predetermined time T1 elapses, the reverse rotation of the angled shaft 63 is stopped). When the remaining amount of the ink is as shown in FIG. 11F, the propeller member 64 is continuously detected by the sensor 66 for the predetermined time T1. As described above, when the propeller member 64 is continuously detected (Step S146: Yes), the controller 10 determines that the remaining ink is in the ink-end state. Then, the controller 10 stops the operated printer 1 forcedly (Step S150).

As described above, according to the second embodiment, the controller 10 determined that the amount of the ink inside the ink storing section 62 is equal to or smaller than a predetermined amount (the ink-end) in a case where the propeller member 64 is continuously detected by the sensor 66 during the rotation of the angled shaft 63 when the angled shaft 63 is stopped at a time when a predetermined time T1 elapses after start of the reverse rotation. Accordingly, the ink-end can be detected appropriately without disposing a level sensor.

In the second embodiment, differently from the first embodiment, rotation in one direction represents the reverse rotation, and the rotation in a different direction represents the forward rotation. In addition, the upper side of the vertical direction corresponds to the first side, and the lower side corresponds to the second side.

Effectiveness

According to the second embodiment, when the angled shaft 63 is rotated reversely (rotated in one direction) the propeller member 64 is rotated to move toward the upper side (first side) of the vertical direction along the axis direction in accordance with the rotation of the angled shaft 63. On the other hand, when the reverse rotation of the angled shaft 63 is stopped, the propeller member 64 is moved to the lower side (second side) of the vertical direction. Then, the sensor 66 detects the propeller member 64 moving as described above in a case where the propeller member 64 is located at the detection position in the vertical direction. Accordingly, as in the first embodiment, under a simple structure, the ink inside the ink storing section 62 can be agitated appropriately, and the state of the ink inside the ink storing section 62 can be detected appropriately.

In other words, in a case where the propeller member 64 is rotated to move toward the upper side in accordance with the reverse rotation of the angled shaft 63, the propeller member 64 can agitate the ink during its movement with rotation. In addition, in a case where the propeller member 64 that is moved to the lower side after the reverse rotation of the angled shaft 63 is stopped is detected by the sensor 66, the state (the remaining amount of the ink and the like) of the ink inside the ink storing section 62 can be detected, for example, by acquiring a falling time of the propeller member 64.

Other Embodiments

Although the printer or the like has been described as an embodiment of the invention, the above-described embodiments are for the purpose of easy understanding of the invention. Thus, the above-described embodiments should be considered not for purposes of limiting the invention. It is apparent that the invention may be changed or modified without departing from the gist of the invention and equivalents thereof belong to the scope of the invention. In particular, embodiments described below also belong to the scope of the invention.

In the above-described embodiments, the printer has been described. However, the invention is not limited thereto. For example, same technology as applied to the above-described embodiments may be applied to various liquid discharging apparatuses using ink jet technology such as a color filter manufacturing apparatus, a dyeing apparatus, a microfabricated apparatus, a semiconductor manufacturing apparatus, a surface processing apparatus, a three-dimensional modeling apparatus, a liquid vaporizing apparatus, an organic EL manufacturing apparatus (particularly, a polymer EL manufacturing apparatus), a display manufacturing apparatus, a deposition apparatus, and a DNA chip manufacturing apparatus.

In addition, in the above-described embodiments, the rotation member is the angled shaft 63. However, the invention is not limited thereto. For example, it may be configured that the rotation member is a solid-core shaft (the cross-section of the shaft is a circular shape), a key is disposed in the shaft, and a key groove is formed in the propeller member 64. Accordingly, the propeller member 64 is rotated in accordance with rotation of the shaft in a state in which the key of the shaft is brought into contact with the key groove of the propeller member 64. When the rotation member is rotated, the propeller member is rotated in the vertical direction. On the other hand, when the rotation member is stopped, the propeller member floats toward the liquid surface.

In addition, in the above-described embodiments, ink is discharged onto a paper sheet S that is wound to be held in the holding drum 31 that rotates. However, the invention is not limited thereto. For example, ink may be configured to be discharged onto a paper sheet S that is supported by a fixed supporting member (so called, a platen).

In addition, the ink discharging method is not limited to a method using a piezo element. For example, the invention may be applied to a thermal printer or the like. In addition, in the above-described embodiments, the ink is the ultraviolet curable ink. However, the invention is not limited thereto.

What is claimed is:

1. A liquid storing device comprising:

a storage unit that stores a liquid to be consumed;

a rotation member that is installed to the inside of the storage unit and is rotated around a rotation axis;

a blade member that is installed to the rotation member so as to be movable in the axis direction of the rotation axis with respect to the rotation member and has specific gravity smaller than that of the liquid;

a detection member that detects the blade member in a case where the blade member is located at a detection position in the vertical direction; and a control unit that determines the amount of the liquid inside the storage unit is equal to or smaller than a predetermined amount at a time when the blade member located at the liquid surface is detected by the detection member when the rotation member is stopped, wherein, in a case where the rotation member rotates in one direction, the blade member agitates the liquid while moving toward the lower side of a liquid surface of the liquid in the vertical direction along the axis direction in accordance with rotation of the rotation member, and wherein, when the rotation of the rotation member in the one direction stops, the blade member floats toward the liquid surface due to buoyancy of the liquid.

2. The liquid storing device according to claim 1, further comprising a control unit that acquires the amount of the liquid inside the storage unit based on a time from when the rotation of the rotation member in the one direction is started to when the blade member is detected by the detection member.

3. The liquid storing device according to claim 1, wherein agitation of the liquid is continuously performed by the blade member during the rotation member is rotated in the one direction.

4. The liquid storing device according to claim 1, wherein the liquid is ultraviolet curable ink, wherein the blade member has a magnet that generates a magnetic field, wherein the detection member has a hall element that detects the magnetic field generated by the magnet at a time when the magnet approaches the detection member, and wherein it is detected that the blade member is located at the detection position at a time when the hall element detects the magnetic field.

5. The liquid storing device according to claim 1, wherein the rotation member is an angled shaft, wherein the blade member has a hole part having a rectangular shape through which the angled shaft perforates and a blade that is installed to the periphery of the hole part and agitates the liquid, wherein, in a case where the angled shaft is rotated in the one direction, the blade member agitates the liquid while moving toward the lower side of the liquid surface in accordance with rotation of the angled shaft in a state in which the angled shaft is brought into contact with the hole part, and wherein, when the rotation of the angled shaft in the one direction is stopped, the blade member floats toward the liquid surface due to buoyancy in a state in which the angled shaft perforates through the hole part.

6. A liquid storing device comprising:

a storage unit that stores a liquid to be consumed;

a rotation member that is installed to the inside of the storage unit and is rotated around a rotation axis;

a blade member that is installed to the rotation member so as to be movable in the axis direction of the rotation axis with respect to the rotation member;

a detection member that detects the blade member in a case where the blade member is located at a detection position in the vertical direction; and a control unit that determines the amount of the liquid inside the storage unit is equal to or smaller than a predetermined amount at a time when the blade member located at the liquid surface is detected by the detection member when the rotation member is stopped, wherein, in a case where the rotation member rotates in one direction, the blade member is rotated to move along the axis direction toward a first side of the vertical direction in accordance with rotation of the rotation member, and wherein, when the rotation of the rotation member in the one direction stops, the blade member is moved to a second side of the vertical direction that is opposite to the first side.

7. A liquid storing cartridge that is detachably attached to a main body of a liquid discharging apparatus, the liquid storing cartridge comprising:

a storage unit that stores a liquid to be consumed;

a rotation member that is installed to the inside of the storage unit and is rotated around a rotation axis;

a blade member that is installed to the rotation member so as to be movable in the axis direction of the rotation axis with respect to the rotation member;

a detection member that detects the blade member in a case where the blade member is located at a detection position in the vertical direction; and a control unit that determines the amount of the liquid inside the storage unit is equal to or smaller than a predetermined amount at a time when the blade member located at the liquid surface is detected by the detection member when the rotation member is stopped, wherein, in a case where the rotation member is rotated in one direction, the blade member is rotated to move toward a first side of the vertical direction along the axis direction in accordance with the rotation of the rotation member, and wherein, when the rotation of the rotation member in the one direction stops, the blade member is moved to a second side that is opposite to the first side of the vertical direction.

* * * * *